US007694392B2

(12) United States Patent
Touchette

(10) Patent No.: US 7,694,392 B2
(45) Date of Patent: Apr. 13, 2010

(54) IMPACT TOOLS WITH SLIDABLE GRIP

(76) Inventor: Shane M. Touchette, 6021 N. Fountain La., Garden City, ID (US) 83714

( * ) Notice: Subject to any disclaimer, the term of this patent is extended or adjusted under 35 U.S.C. 154(b) by 0 days.

(21) Appl. No.: 11/999,724

(22) Filed: Dec. 5, 2007

(65) Prior Publication Data

US 2008/0168629 A1 Jul. 17, 2008

Related U.S. Application Data

(60) Provisional application No. 60/873,065, filed on Dec. 5, 2006, provisional application No. 60/944,869, filed on Jun. 19, 2007.

(51) Int. Cl.
*B25G 1/10* (2006.01)

(52) U.S. Cl. ..... 16/430

(58) Field of Classification Search ..... 16/430; 173/162.1, 162.2, 170; 81/177.1, 185.2, 81/20

See application file for complete search history.

(56) References Cited

U.S. PATENT DOCUMENTS 271,303 A * 1/1883 Blaker ..... 30/308.1
3,751,094 A * 8/1973 Bohler ..... 294/58
3,981,043 A * 9/1976 Curry ..... 16/430
5,125,130 A * 6/1992 Stanish ..... 16/430
5,920,944 A * 7/1999 Biggs et al. ..... 15/144.4
5,974,775 A * 11/1999 Niehuss ..... 56/400.17
6,464,272 B1 * 10/2002 Michaud ..... 294/58
6,889,405 B2 * 5/2005 Ritrovato et al. ..... 16/430
2003/0200631 A1 * 10/2003 Clarke ..... 16/430

* cited by examiner

*Primary Examiner*—Victor Batson
*Assistant Examiner*—Matthew Sullivan
(74) *Attorney, Agent, or Firm*—Pedersen & Co., PLLC; Ken J. Pedersen; Barbara S. Pedersen

(57) ABSTRACT

Tools and methods of making tools that are swung toward a work-piece are more accurate and/or safer to use because of a moveable grip provided on the tool handle. The tool handle slides through the moveable grip, with minimal or no rotation or shifting relative to the grip. The movable grip eliminates the need for the forward hand of the user to loosen its grip during portions or all of the swing, eliminates the need for the hand itself to slide along the surface of the handle, and, importantly, greatly reduces or eliminates the chance that the tool and the impact head of the tool hand will rotate or shift relative to user's hand(s). The moveable grip and handle are preferably rigid and hard and mated in shape and size so that rotation and shifting is reduced or eliminated. The preferred embodiment includes one or more control members for retaining or latching the moveable grip in one or more desired locations on the handle, so that the moveable grip may be prevented from sliding along the handle until the user desires it to slide.

6 Claims, 25 Drawing Sheets

IMPACT TOOLS WITH SLIDABLE GRIP

This application claims priority of U.S. Ser. No. 60/873,065, filed Dec. 5, 2006; and also U.S. Ser. No. 60/944,869, filed Jun. 19, 2007, the entire disclosures of which are incorporated herein by this reference.

BACKGROUND OF THE INVENTION

1. Field of the Invention

The present invention relates generally to hand-operated tools, and especially tools that a user swings to make an impact upon a work-piece, whether the impact is for hitting, chipping, or cutting the work-piece. The present invention relates more especially to sledge hammers, axes, hatchets, picks, adzes, pulaskis, pick-axes, or other hitting, picking, chipping, or cutting tools that are moved, during use, in a direction including at least a component that is transverse to the longitudinal axis of the tool handle.

2. Background and Related Art

Traditional sledge hammers, picks, axes, and other impact tools that are swung, comprise an elongated handle and an impact, pick, chipping, or cutting head that is generally transverse to the longitudinal axis of the handle. These tools are used by swinging the tool toward the work-piece in an arc swing, wherein the swing moves through a plane that is generally perpendicular to the plane of the work-piece, or at least generally perpendicular to the plane of the desired impact. Frequently, the work piece is orientated so that the surface to be impacted is generally horizontal, and the swing plane is generally vertical. A vertical swing plane is common, for example, when a user is splitting wood for a woodpile or hammering a post into the ground. Alternatively, the work piece may be orientated so that the surface to be impacted is non-horizontal, and the swing plane is non-vertical. A non-vertical, possibly even horizontal, swing plane is common, for example, when a user is chopping down a tree or sledge-hammering a wall during building demolition.

For most swings of the tools of interest in this document, the swing action may be described as an arc swing wherein the user's shoulder(s) or elbow(s) act as a rotation point and the arm(s) swing the tool toward the work-piece in such a way that the tool head hits the work-piece, said swinging having at least a component of movement/force that is transverse to the longitudinal axis of the handle and is parallel to the axis of the tool head. In a vertical or generally vertical swing plane, the user usually prepares by lifting or swinging the tool generally over his/her shoulder to place the tool in a position of potential energy above the work-piece. The user typically grasps the handle of the tool with both hands, and raises the tool above his shoulder by various means, depending upon the tool, the user's strength and preference, and the obstructions around the user. The user may, for example, lift the tool up in front him/her and back generally over his/her shoulder in about a 180 degree arc before pausing and reversing the direction his/her arm movement to produce the forward, downward swing at the target. Alternatively, the user may lift the tool up beside or behind him/her to the position generally over his/her shoulder, prior to producing the forward, downward swing at the target. In a non-vertical swing, the user typically moves the tool rearward to a position behind him/her, and then, mainly using his/her own strength rather than gravity, swings the tool forward toward the target at whatever level and whatever angle is appropriate for reaching the target.

In any event, the user typically has his/her hands separated from each other during the preparatory part of the swing, that is, the lifting of the tool above the shoulder or the moving of the tool rearward to prepare for the forward swing. In the preparatory part of the swing, one hand typically is nearer the rear end (proximal end) of the handle and the other hand nearer the tool head (near the distal end of the handle). This hand separation helps the user more easily lift the typically-heavy tool head, before proceeding to deliver the forward swing and blow to the work-piece.

As the user swings the tool to deliver an impact, the user's rearward hand stays in place, or substantially in place, on the handle, and the forward hand typically slides proximally along the handle toward the rear end of the handle and, hence, toward the rear hand. This allows the tool to swing forward from the user to hit the work-piece without requiring the user to bend over very far. This also maximizes the force of the long-handled tool impacting the work-piece, as both hands are near the proximal end of the handle and increase leverage. This is the natural swing when using such tools, and it allows the user to use his/her strength to best advantage to produce a large impact of the tool against the work-piece.

Blaker (U.S. Pat. No. 271,303, issued Jan. 30, 1883) and Curry (U.S. Pat. No. 3,981,043, issued Sep. 21, 1976) disclose members that may be placed around conventional ax handles for gripping by the user's forward hand. Both of Blaker and Curry disclose flexible or compressible sleeve systems for reducing blistering of the hand or for shock absorption.

Blaker describes his device as a "slidable grip, formed of leather, vulcanized rubber, canvas, or other suitable materials, fitting the handle loosely, and of such size as to be readily and conveniently clasped in the hand, which grip is slipped on the handle before the lower grip is put on. This sliding grip will be found to be of the greatest usefulness in connection with the spring-handle, for a spring-handle is necessarily too small to be conveniently grasped or held in the hand, and if it were cased to secure a good hand-hold the casing would interfere with its elasticity, and the sliding grip is therefore a primary necessity in connection with a spring-hand, and moreover, it saves the hands from the blistering caused by the ordinary wooden handles until the hands get calloused or hardened."

Curry describes his device as "a new and improved hand grip for the handle of a tool . . . to permit one hand of the user to either firmly grasp the handle of a tool or to slide along the handle of a tool wherein the tool handle requires grasping by both hands of the user . . . a new and improved hand grip adapted for sliding movement between stopping means disposed proximate both ends of a tool handle . . . Disposed between the stops is a hand grip sized to receive one hand of the user and so as to substantially circle the tool handle . . . The hand grip may be compressible in directions perpendicular to the length of the tool handle to permit non-sliding grasping of the handle when desired and may also be provided with end pieces compressible in directions parallel to the length of the tool handle to absorb shocks resulting from impact of the hand grip with the stops."

Although Blaker and/or Curry may provide hand protection and/or cushioning, the inventor believes that these prior art devices do not address other inherent problems in the natural swing of the tools that is described above. In a typical swing, the user loosens his/her forward hand so that it can slide proximally along the handle toward the rear end of the handle, as described above. This loosening is problematic because it allows inaccuracy in the swing and the impact. Ideally, the handle and head both should be aligned in the swing plane as they approach and impact the work-piece, but, once the forward (distal) hand is loosened, the user has less control over the direction and orientation of the tool and especially over the direction and orientation of the tool head, and the tool frequently rotates 20-30 degrees and even up to 45 degrees or more, in the user's hands during the swing and before impact. This causes an inaccurate and/or inconsistent swing and impact. Because the user's forward hand is loosened and because the user's rearward hand is naturally flexible/compressible, the inventor believes that the tool frequently rotates to an extent that moves the tool head longitudinal axis TL out of the plane of the swing and changes the point and direction of impact on the target. Thus, "glancing blows" or off-center blows are often delivered or the target is completely missed.

The prior art devices of Blaker and Curry do not solve this problem because, the inventor believes, they provide a member that can move on the handle of the impact tool in more than just a longitudinal direction parallel to the length of the handle, and/or they provide a member that compresses, flexes, or shifts to allow the location of the central axis L of the handle relative to the hand to change during the swing. The inventor believes that a major problem in the "natural swing" and in devices such as Blaker and Curry is that they allow rotation of the slidable member that is provided on the handle and/or they allow the handle central axis L to shift relative to the slidable member, thus allowing rotation of the tool in the user's hand(s) and/or transverse shifting of the tool in the user's hands. The inventor believes, therefore, that there is a need for his invention that includes a slidable sleeve system with a system for preventing rotation or twisting and preventing transverse shifting, of the tool in the user's hand(s).

SUMMARY OF THE INVENTION

The present invention comprises apparatus and methods for making tools that are swung toward a work-piece more accurate, easy, and/or safe to use. The present invention may be used on impact, pick, cutting, or combination tools that are swung during use, such as hammers, sledge hammers, axes, picks, pick axes, pulaskis, adzes, or other tools that have a head or head portion extending generally transverse to the handle axis and/or that are moved toward the work-piece with a component of motion that is transverse to the handle axis. The present invention comprises a movable grip on the handle of such tools, which may be grasped by a hand of the user during use of the tool at any time that movement of the user's two hands relative to each other on the handle is needed or convenient, and/or at any time movement of one hand relative to the handle is needed or convenient.

The movable grip preferably slides along the handle in a direction parallel to the longitudinal axis of the handle, providing the user a firm, reliable, predictable, and smooth-moving grasp-point. By using this movable grip, the user may move his hand relative to the handle, relative to the tool head, and relative to his/her other hand, in a direction and manner much like the user's natural hand movement would be during normal use of the tool, except that the preferred moveable grip does not allow significant rotation of the tool in the user's hands and does not allow significant transverse shifting of the tool relative to the moveable grip. The movable grip eliminates the need for the forward hand of the user to loosen its grip during portions or all of the swing, and eliminates the need for the hand itself to slide along the handle in contact with the surface of the handle. The moveable grip is preferably rigid, non-compressible, mated for non-rotation, and closely fit to the rigid handle of the tool, so that the moveable grip does not allow the handle to significantly rotate in the sleeve and so that the central axis of the tool handle does not significantly shift transversely relative to the moveable grip.

The invented moveable grip and/or the tool upon which it is provided is/are adapted so that the moveable grip does not (preferably, cannot) rotate relative to the tool handle on which it is supplied. Various means or systems may be provided to create said adaptation, with the preferred being that the moveable grip is a rigid sleeve surrounding a handle wherein said sleeve is shaped to mate with a non-cylindrical and rigid handle in such a way that the sleeve cannot rotate on the handle. This may be done by the sleeve being the same or generally the same shape as the handle, for example, a sleeve that is generally oval in end-view (or cross-section) may cooperate with a handle that is generally oval in transverse cross-section, wherein said oval sleeve may slide along the handle but may not rotate around the handle. Preferably, the shape of the sleeve and the shape of the handle match and mate for a significant distance along the handle to supply the full desired extent of swing.

Preferably, also, the fit of the sleeve on the handle is not so tight as to hinder longitudinal sliding, but is tight/snug enough to not allow rotation and to not allow significant transverse movement of the handle in the moveable grip. For example, an oval sleeve will slide along an oval handle and not rotate around the oval handle, as long as the oval sleeve is not so large in its inner diameter/dimension so as to rotate by slipping around the smaller handle in spite of the oval shape. For example, the oval sleeve, even though small enough relative to the handle to prevent said rotation, should also be small enough to prevent the handle from moving side-to-side in the sleeve more than about 6 mm.

Alternatively, other mating or matching systems may be used to retain and guide the sleeve to slide only longitudinally and not to significantly rotate or twist on the tool handle and not to significantly shift transversely relative to the handle. For example, a key-way, slot, or other mating portions of the sleeve and handle may obtain this desired result.

Rotation of the tool handle relative to the hand (in tools without a slidable sleeve) or rotation of the tool handle relative to the securely-grasped sleeve, will typically rotate the head of the tool out of the plane of the swing as described above in the Background and Related Art section. If the tool rotates during the swing, it is likely that the swing will not be accurate and/or the impact head will not be "square-on" when it approaches the target and/or hits the target. The preferred rotation-prevention system limits or preferably prevents rotation of the tool relative to the user's hands by limiting or preventing rotation of the tool to the sleeve, and, thus, limits or prevents inaccuracies in the swing and/or in the direction and orientation of the tool head approaching the target. The preferred transverse-shift-prevention feature of the tool limits or preferably prevents movement of the tool handle in a direction perpendicular to the longitudinal axis of the handle, and, thus, also limits or prevents inaccuracies in the swing and/or the direction of the tool head approaching the target. Thus, the preferred rotation-prevention and shift-prevention system(s) may eliminate tool operation problems that can increase mistakes, accidents, inaccurate impacts, and other unsafe conditions. Therefore, use of the tool is typically more powerful and accurate, and fewer and safer swings are typically needed to accomplish a task.

The moveable grip may be provided as a slidable sleeve around the tool handle that may slide from near the head of the tool to near the rear hand grip region of the handle. The moveable grip or sleeve may be retained on the handle by a rear grip, stop, or other enlargement provided near the handle end. Preferably, the rear grip, stop, or other enlargement is in front of (distal relative to) the place where the rear hand will grip the handle; this keeps the moveable grip or sleeve from "ramming" into the rear hand and prevents pain, pinching, and/or impact on the rear hand that would disrupt the rear hand grip and/or cause other problems.

The moveable grip/sleeve may be other shapes than shown in the Figures and may cooperate with the handle in different ways than shown, and may have movement limited by other structure than shown, that is, limited from ramming the rear hand, limited from sliding off of the handle, and limited from rotation especially during use in an arc swing.

BRIEF DESCRIPTION OF THE DRAWINGS

FIG. 5 illustrates movement of the moveable hand grip.

FIG. 22 shows the control member moved out to near the proximal hand grip, substantially out of the way of the movable grip. FIG. 23 shows the control member moved to near the moveable grip when the grip has slid to near the impact head of the tool, in which position the control member will stop the moveable grip from unwanted sliding. FIG. 23 illustrates the moveable grip near but not abutting against the tool head attachment cylinder/member and the control member near but not abutting against the moveable grip, but it will be understood that, often, the moveable grip will typically be moved all the way to the head attachment cylinder/member and the control member will be moved all the way to abut against the moveable grip, so that the moveable grip is snugly "captured" between said attachment cylinder/member and the control member.

In FIG. 24, the moveable grip has been moved generally to the center of the handle, and the two control members have also been moved toward the center of the handle on each end of the grip, so that the grip will be retained in that position.

DESCRIPTION OF THE PREFERRED EMBODIMENTS

Referring to the Figures, there are shown several, but not the only, embodiments of the invented moveable grip system for hammer, axis, pick, chisel, cutting tools, and other impact tools, including but not limited to those tools that are portrayed and/or described in this document. For the purposes of this description and the claims, the term "impact tool" includes hitting, cutting, chipping, and other tools that are used by swinging the tool at a target, wherein said swing has a component of motion that is non-parallel to the longitudinal axis of the tool. The preferred embodiments are not used with tools such as "slide hammers" that are intended for impact in a direction parallel to the longitudinal axis of the handle In other words, the preferred embodiments are not used in a manner that involves the user holding the grip in one hand and then "punching" or sliding the handle through the grip toward the work-piece to hit, punch, or pull the tool in a direction parallel to the handle. Instead, the preferred embodiments are swung by the user to move the head of the tool in an arc, preferably to hit, pick, or cut the work-piece when the head of the tool contacts the work-piece at a location on the arc.

Figure 1:
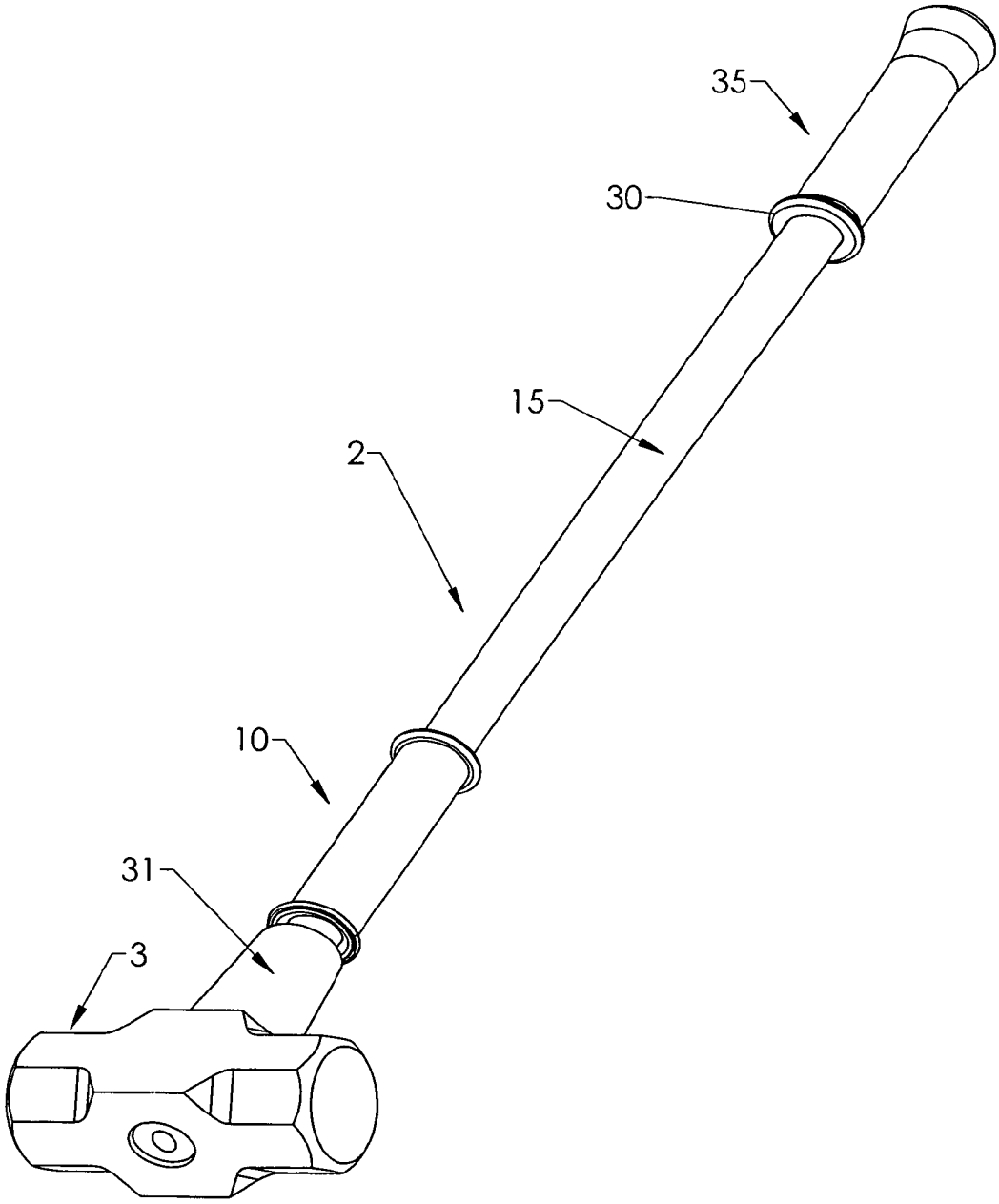
FIG. 1 is a perspective view of one embodiment of an invented sledge hammer with one embodiment of the invented moveable hand grip, and one embodiment of a rear hand grip. The embodiment of FIG. 1 features an oval-shaped tool handle and an oval-shaped moveable hand grip that slides along said tool handle, but, by virtue of its oval shape and close fit with the handle, is not rotatable on said handle.
Figure 2:
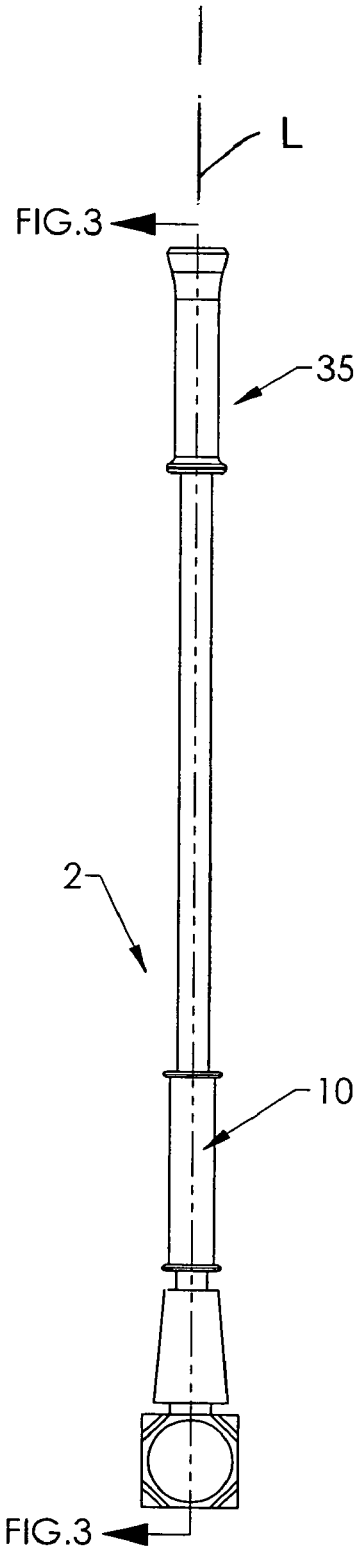
FIG. 2 is a side view of the embodiment of FIG. 1.
Figure 3:
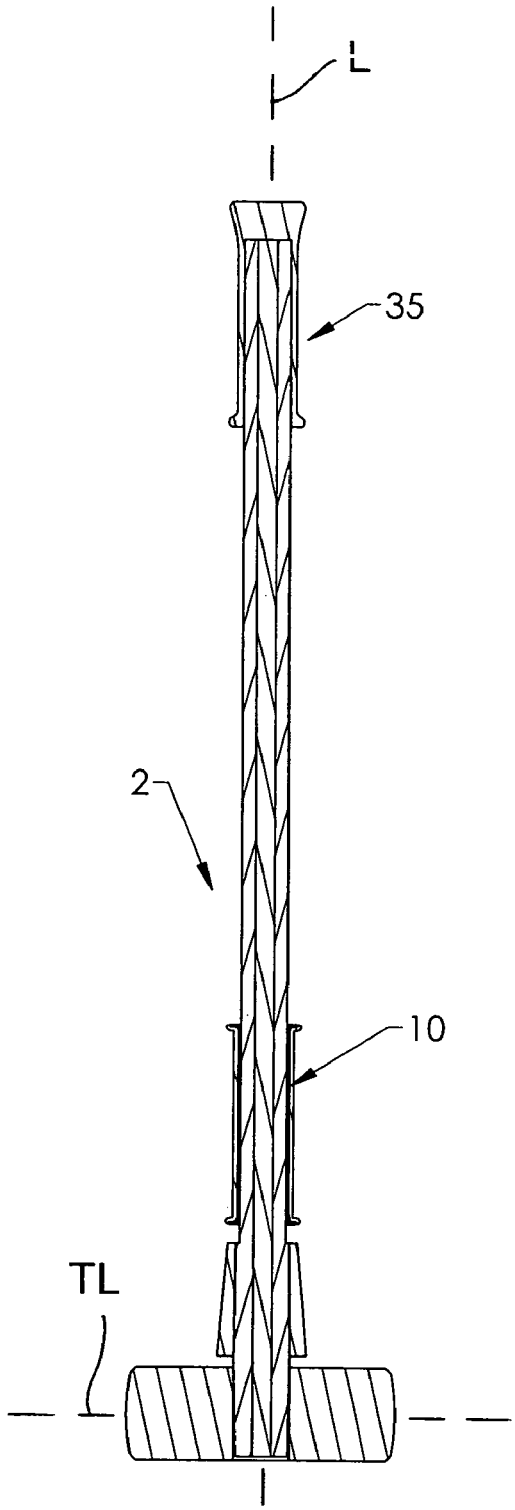
FIG. 3 is a cross-sectional view of the embodiment of FIGS. 1 and 2, viewed along the line 3-3 in FIG. 2.
Figure 4:
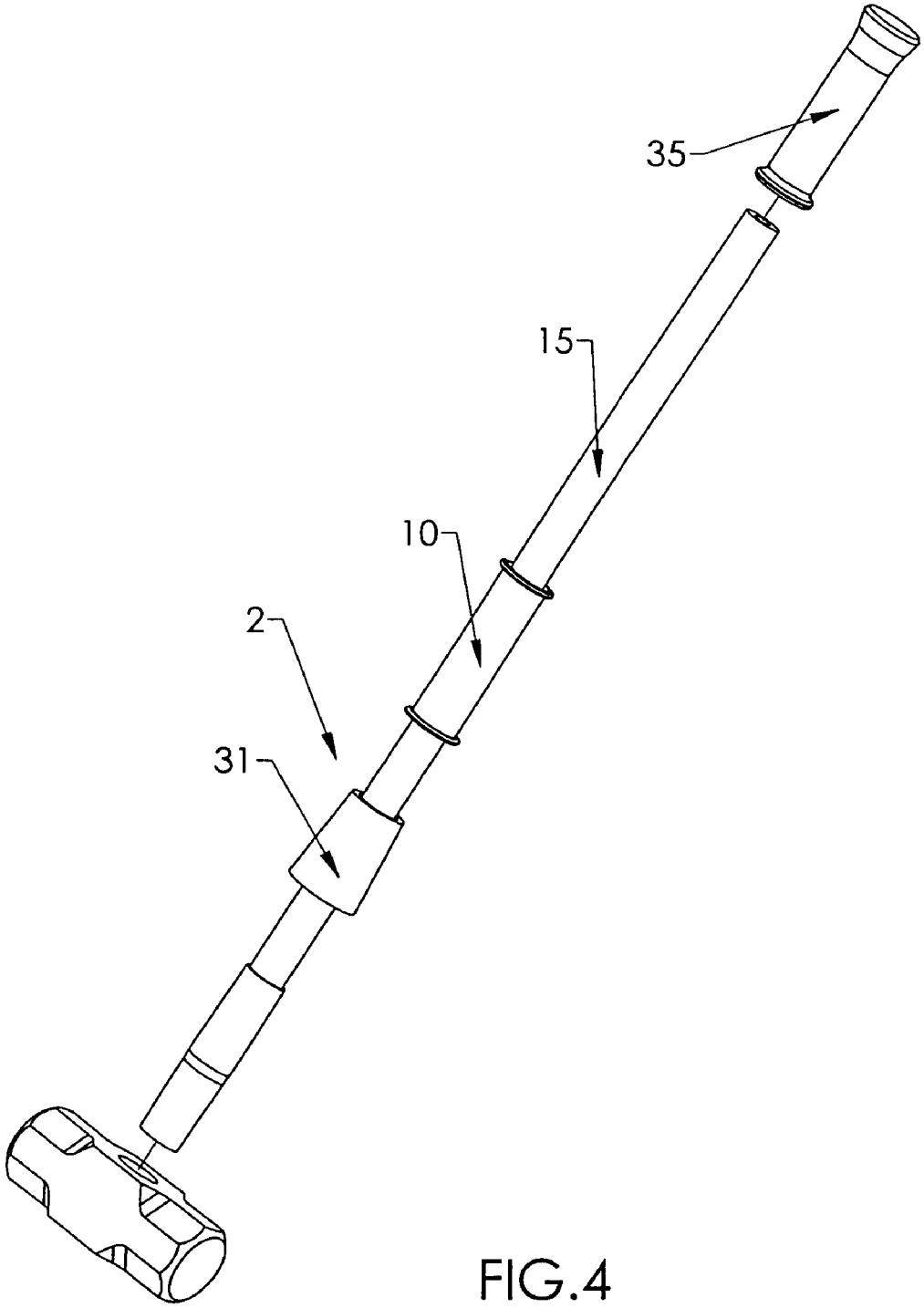
FIG. 4 is an exploded view of the embodiment of FIGS. 1-3.
Figure 7:
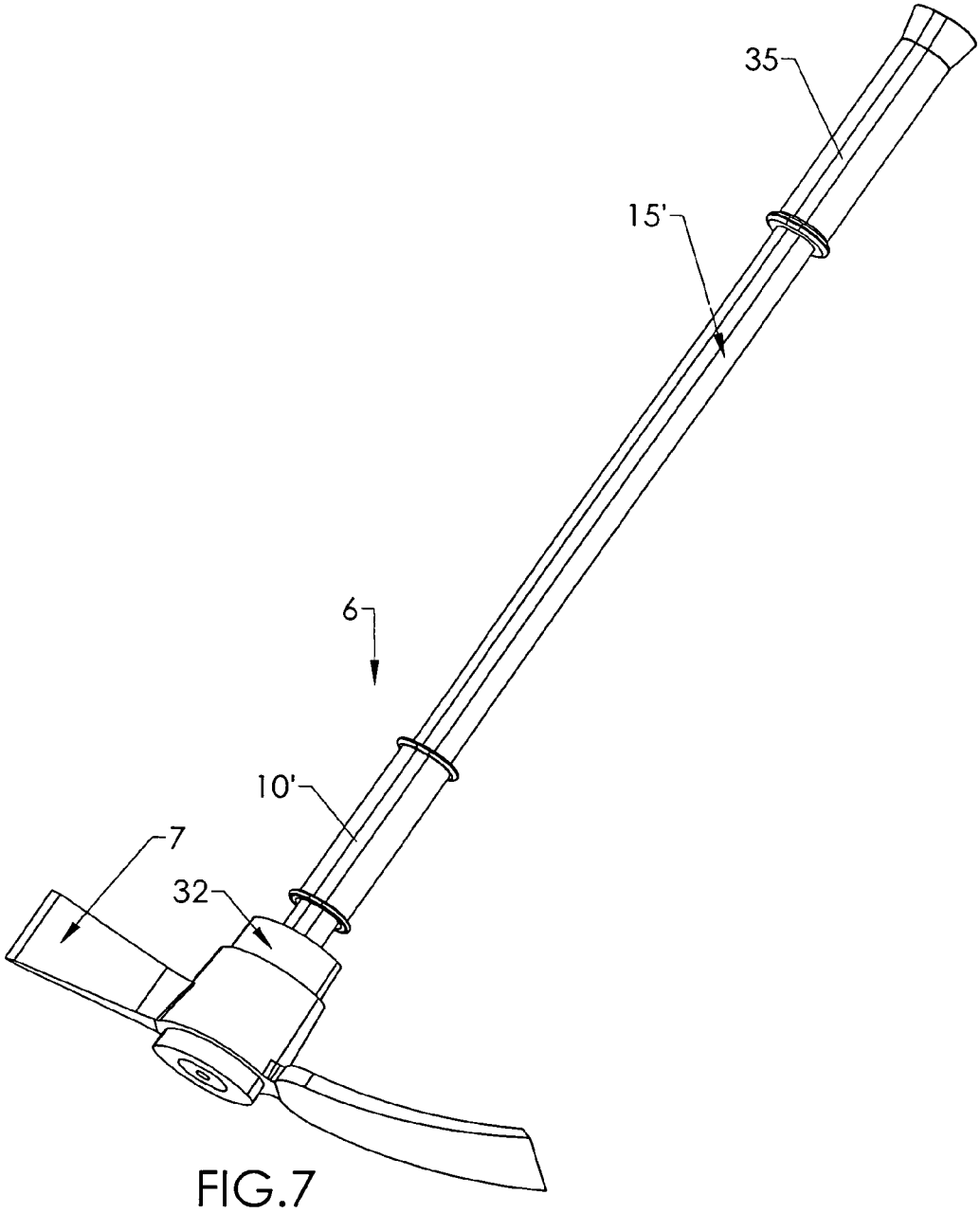
FIG. 7 is a perspective view of another embodiment of the invention, wherein the tool handle, moveable hand grip, and rear hand grip of the embodiment of FIG. 5 is provided for a pulaski (having an axe on one end of the head and an adze on the other end of the head).
Figure 8:
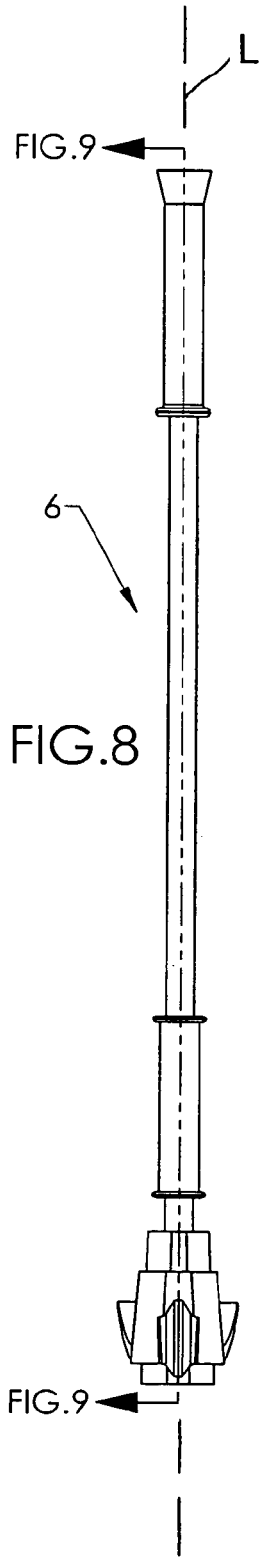
FIG. 8 is a side view of the embodiment in FIG. 7.
Figure 9:
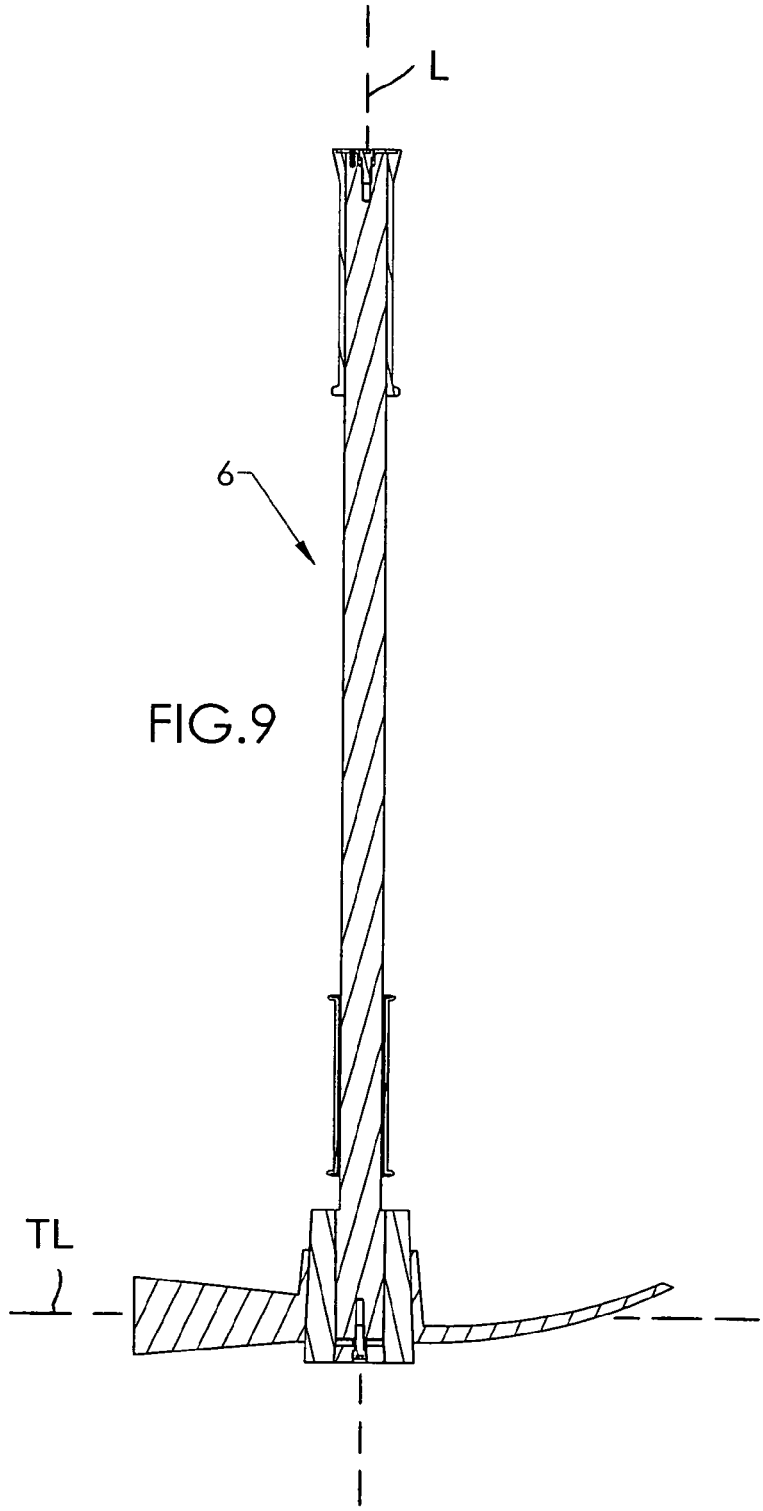
FIG. 9 is a cross-sectional view of the embodiment of FIGS. 7 and 8, viewed along the line 9-9 in FIG. 8.
Figure 10:
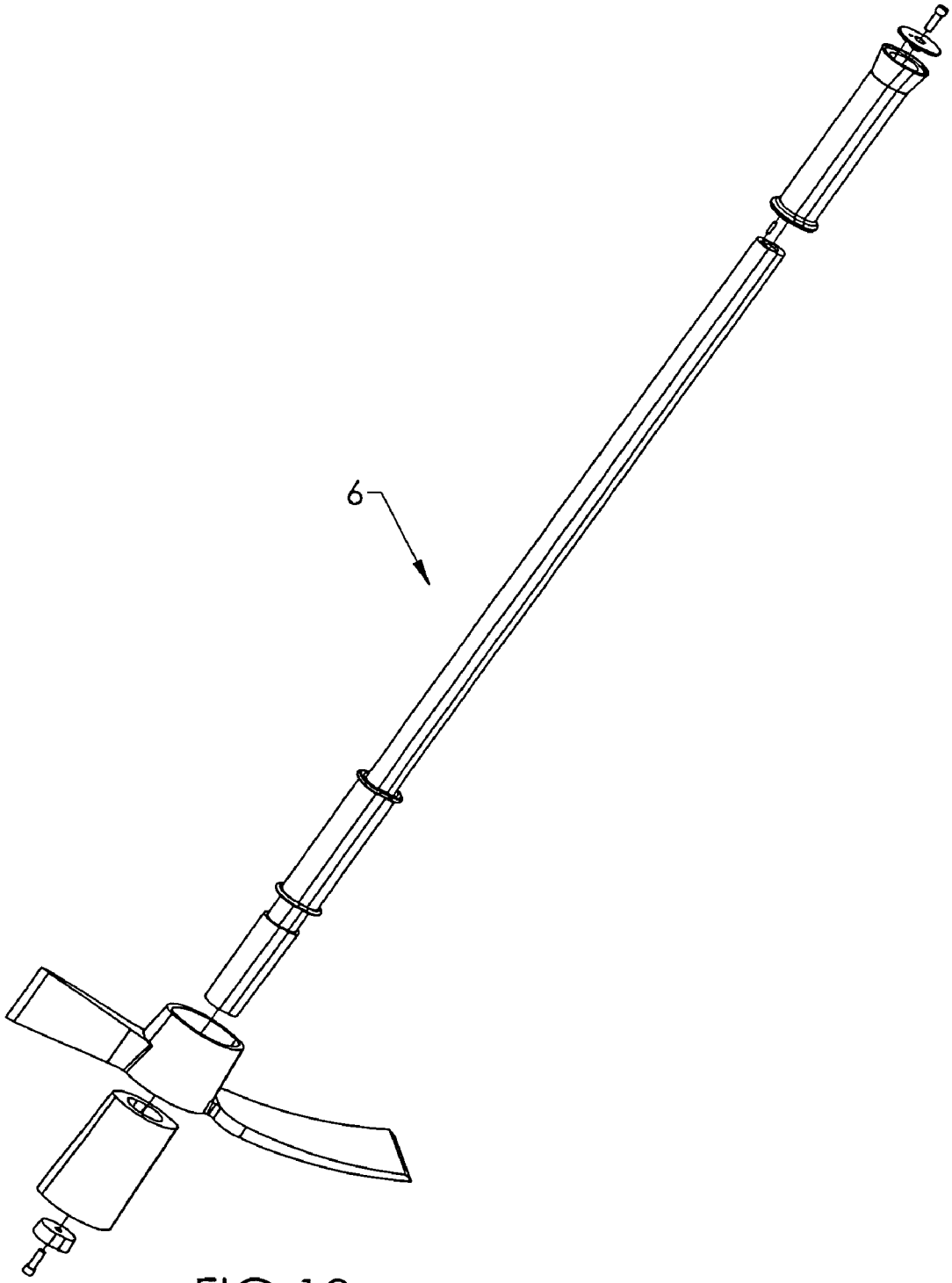
FIG. 10 is an exploded view of the embodiment of FIGS. 7-9. Note that the tool of FIGS. 7-10 includes an alternative head attachment system, including an attachment cylinder that extends through the tool head and also serves as a distal-end stop for limiting, and optionally cushioning, movement of the moveable hand grip in the distal direction.
Figure 11:
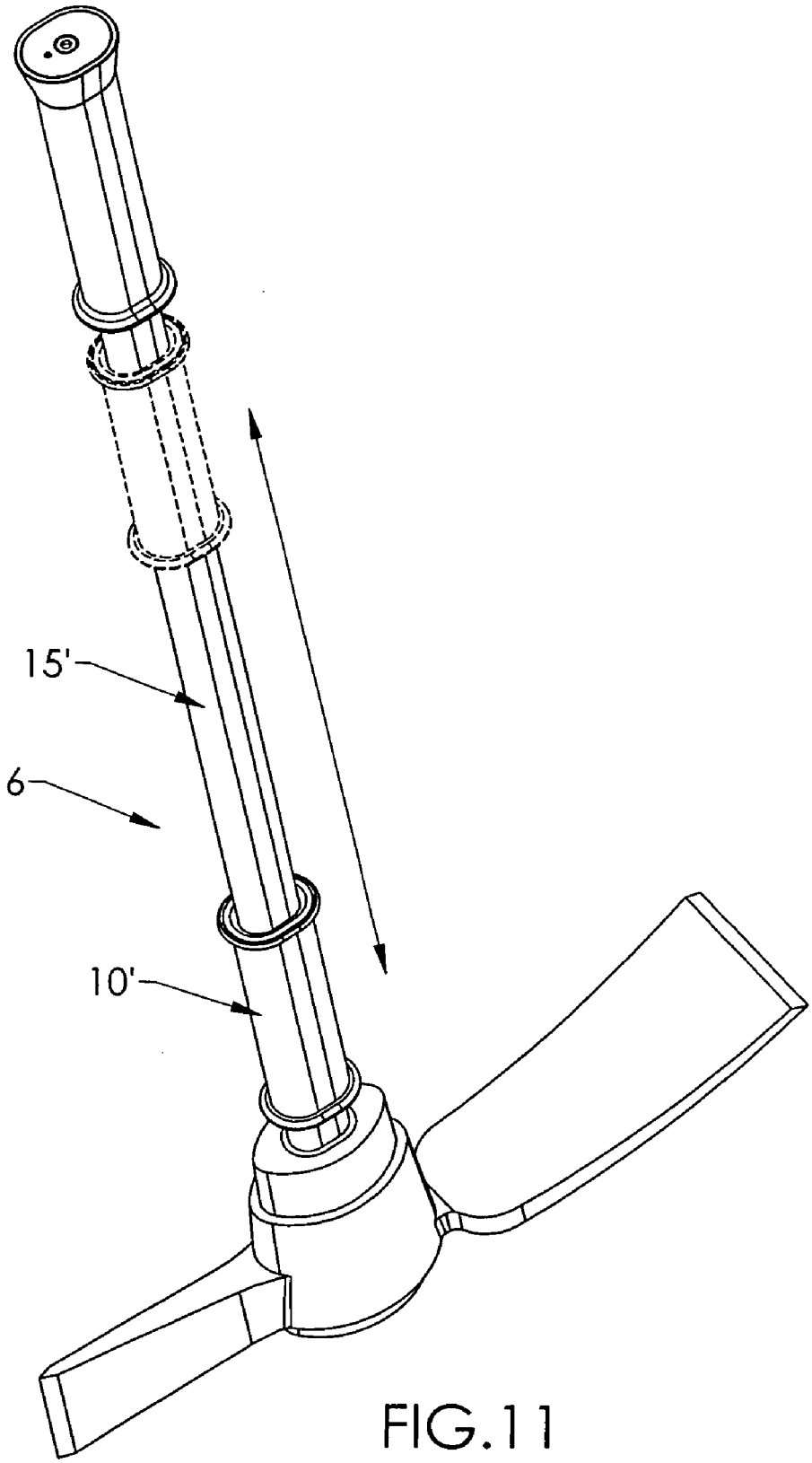
FIG. 11 illustrates the approximate range of motion of the moveable sleeve of the embodiment of FIGS. 7-10, wherein the moveable hand grip is shown in a position slid to near its distal limit on the handle and, in dashed lines, in a position slid nearly to the proximal limit on the handle.
Figure 12:
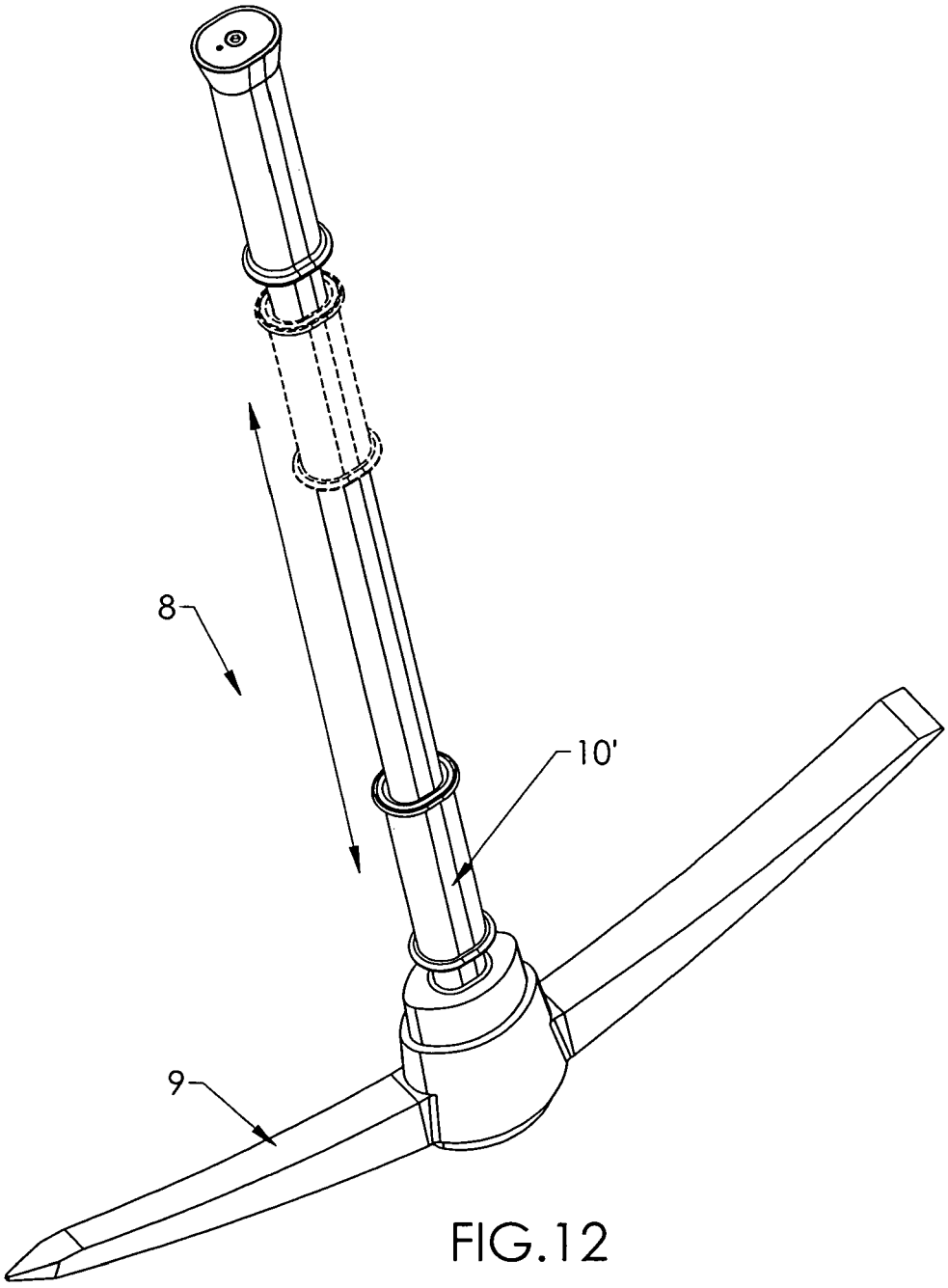
FIG. 12 is a perspective view of another embodiment of the invention, wherein the tool handle, moveable hand grip, and rear hand grip of the embodiment of FIG. 5 is provided for a pick (having a point on one end of the head and a chisel on the other end of the head). The sleeve is portrayed as sliding between a distal position, and, in dashed lines, a proximal position.
Figure 13:
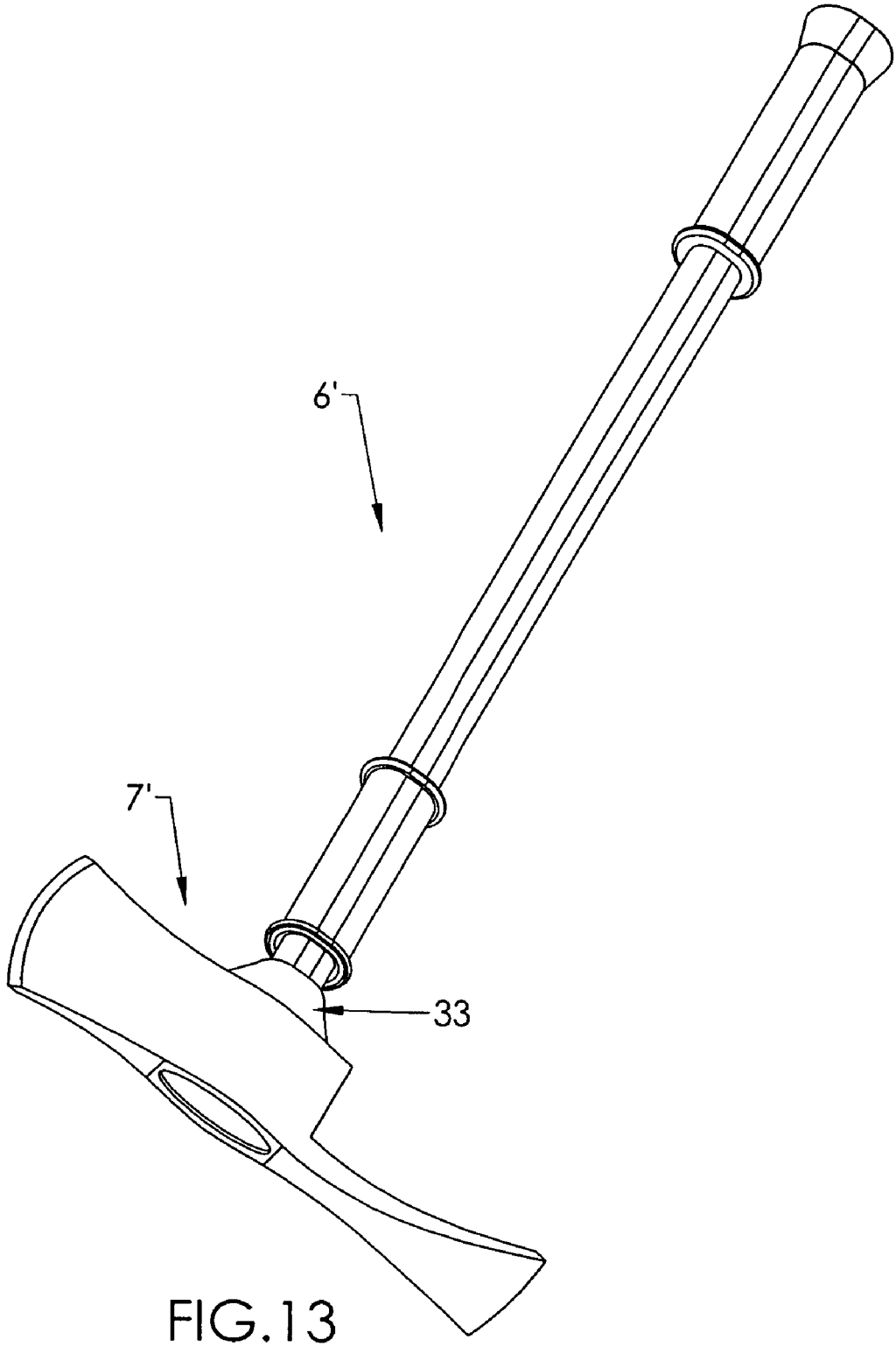
FIGS. 13-17 illustrate perspective, side, cross-sectional, exploded, and range-of-sleeve-movement views, respectively, of another embodiment of the invention, wherein the tool handle, moveable hand grip, and rear hand grip of the embodiment of FIG. 5 is provided for an alternative pulaski-type tool head. Note that the tool of FIGS. 13-17 includes an alternative head attachment system, including an alternative attachment member having a generally conical proximal end, wherein the alternative attachment member extends through the tool head and also serves as a distal-end stop to limit, and optionally cushion, movement of the moveable hand grip in the distal direction.
Figure 14:
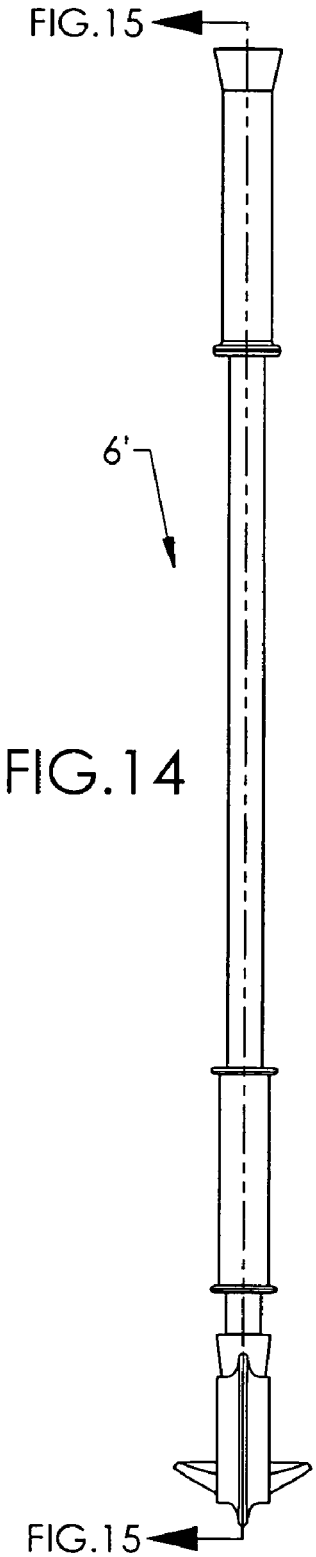
Figure 15:
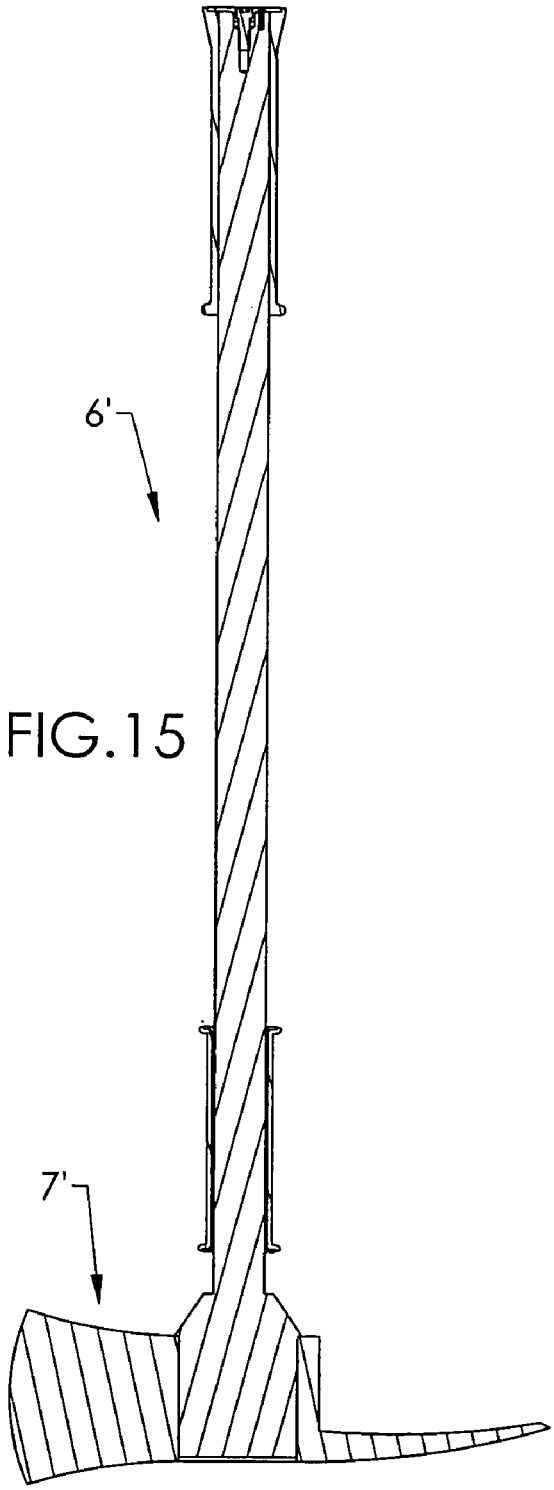
Figure 16:
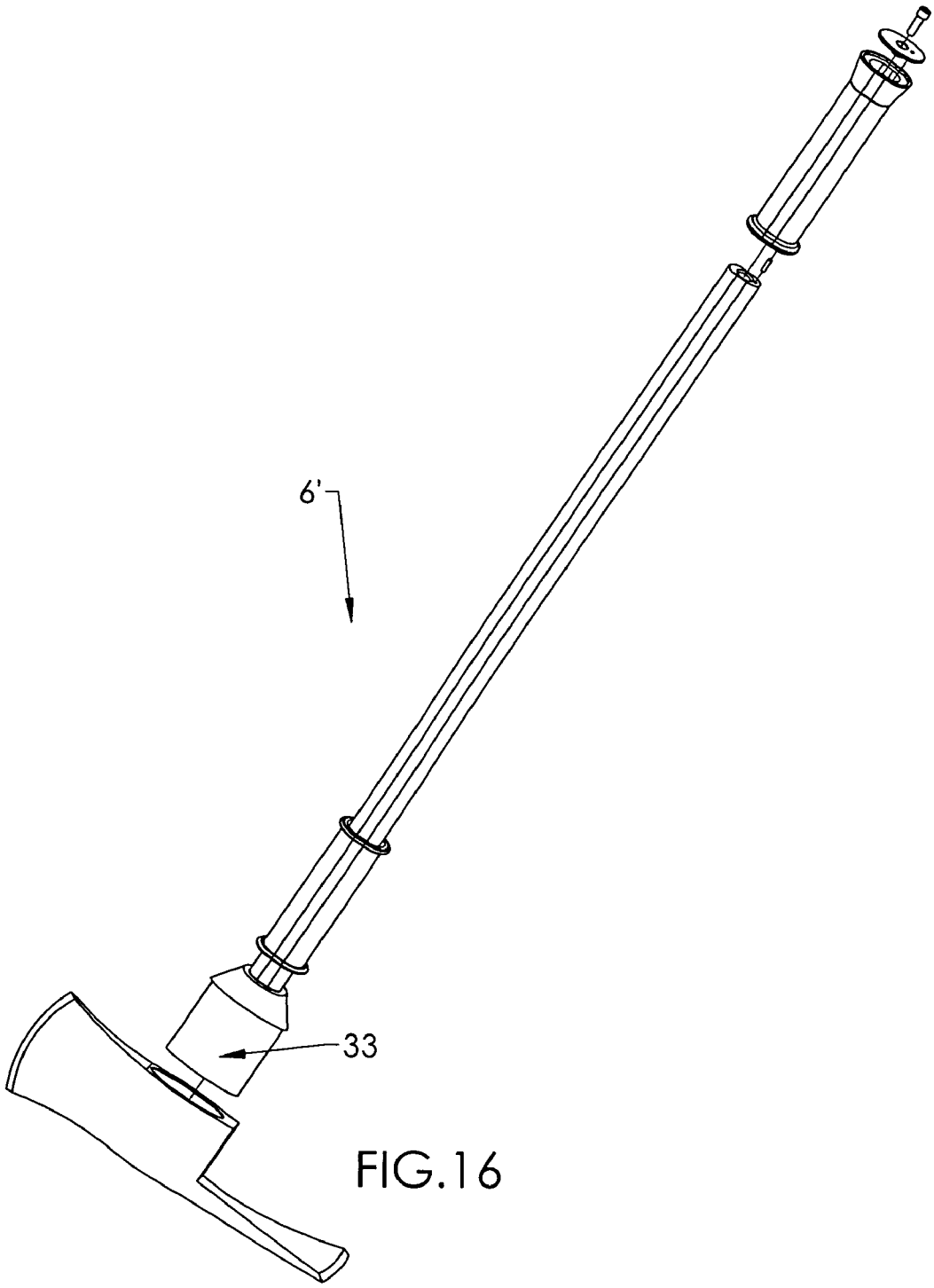
Figure 17:
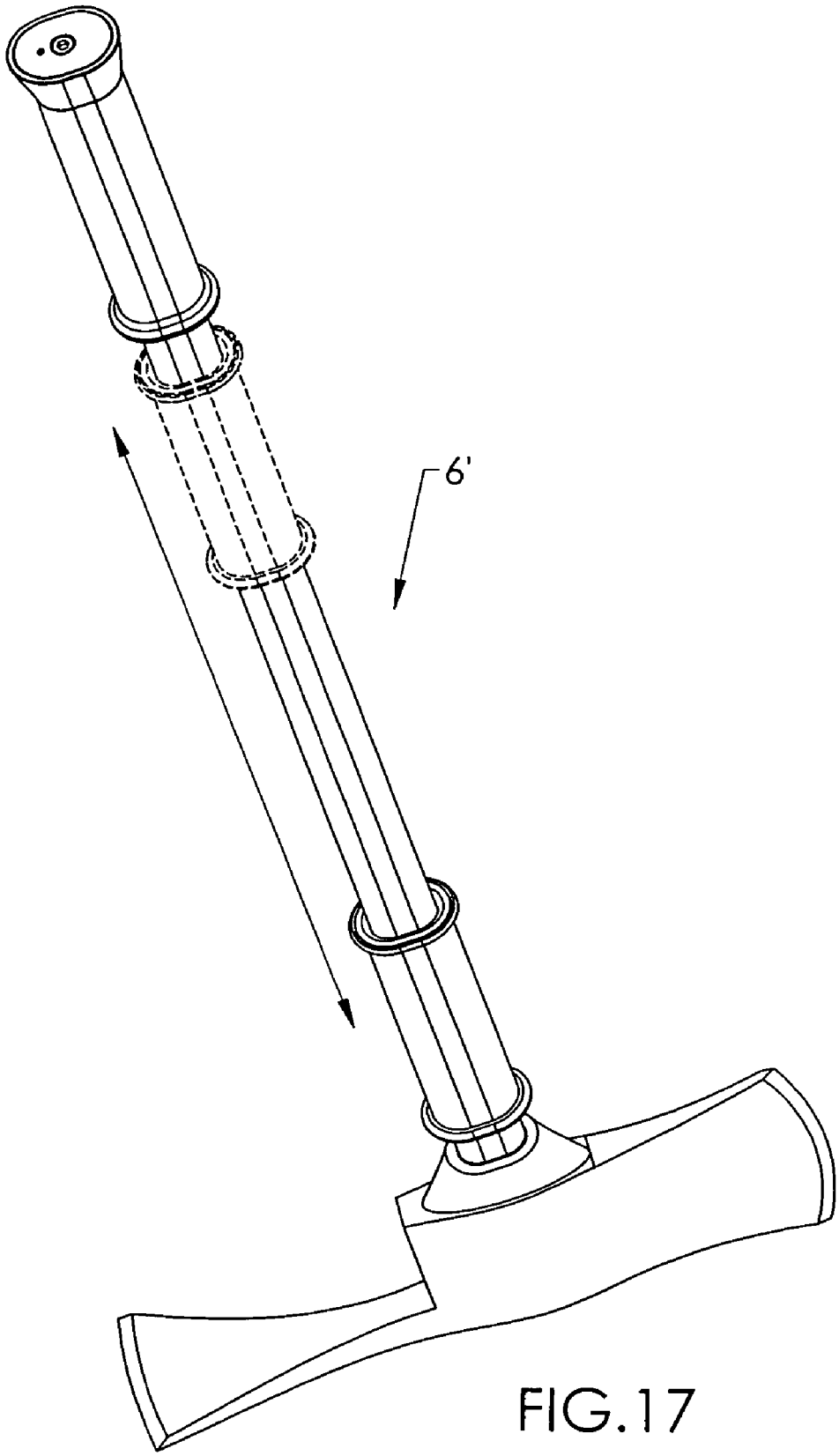
Figure 18:
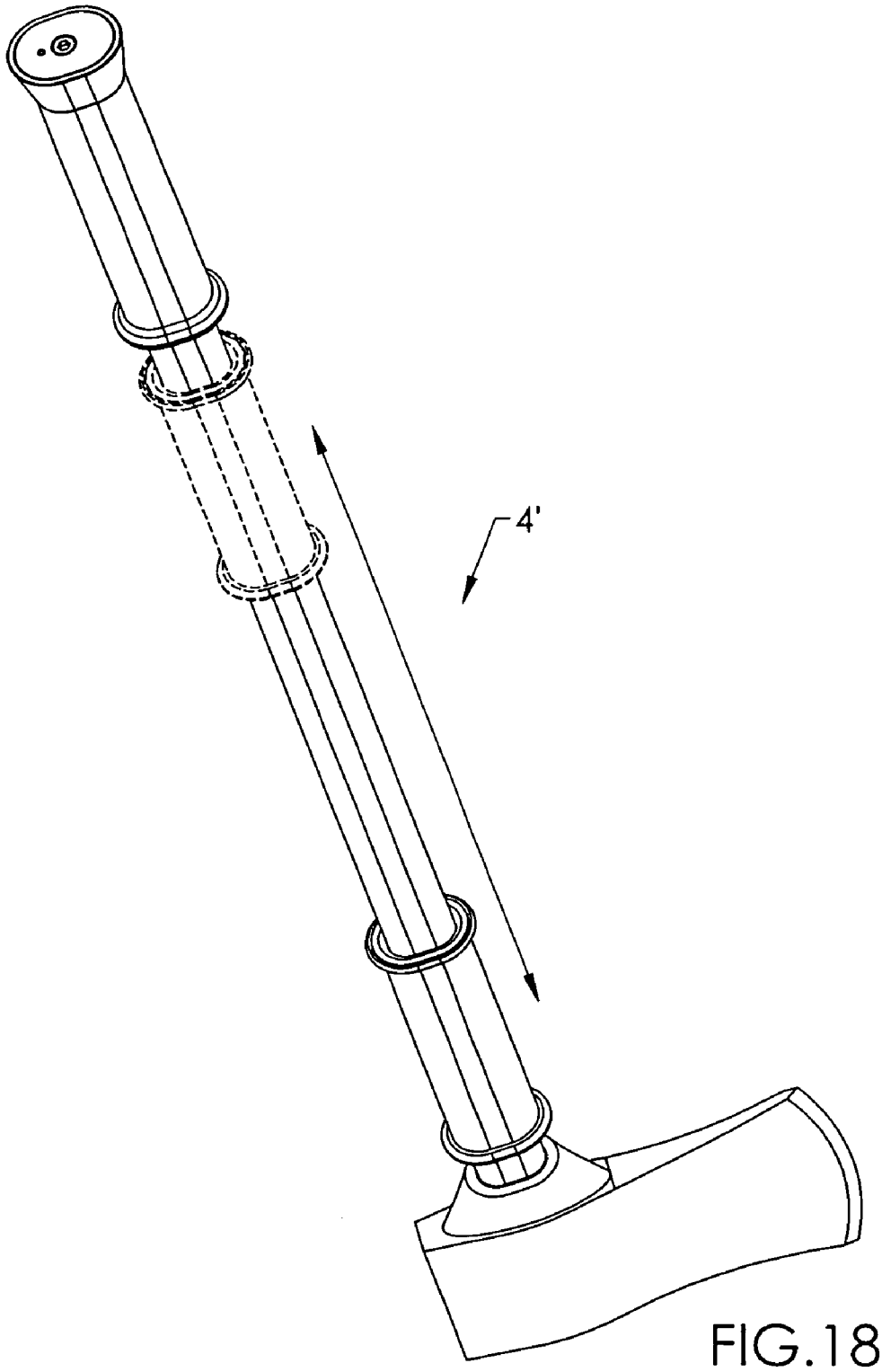
FIG. 18 is a perspective view of an alternative axe embodiment of the invention, wherein the tool handle, moveable hand grip, and rear hand grip of FIG. 5 are again provided. Movement of the moveable hand grip is shown, between a distal position (solid lines) and a proximal position (dashed lines). An alternative head attachment member is portrayed, wherein the attachment member is an oval shape for fitting inside the axe head and has a generally conical proximal end.
Figure 19:
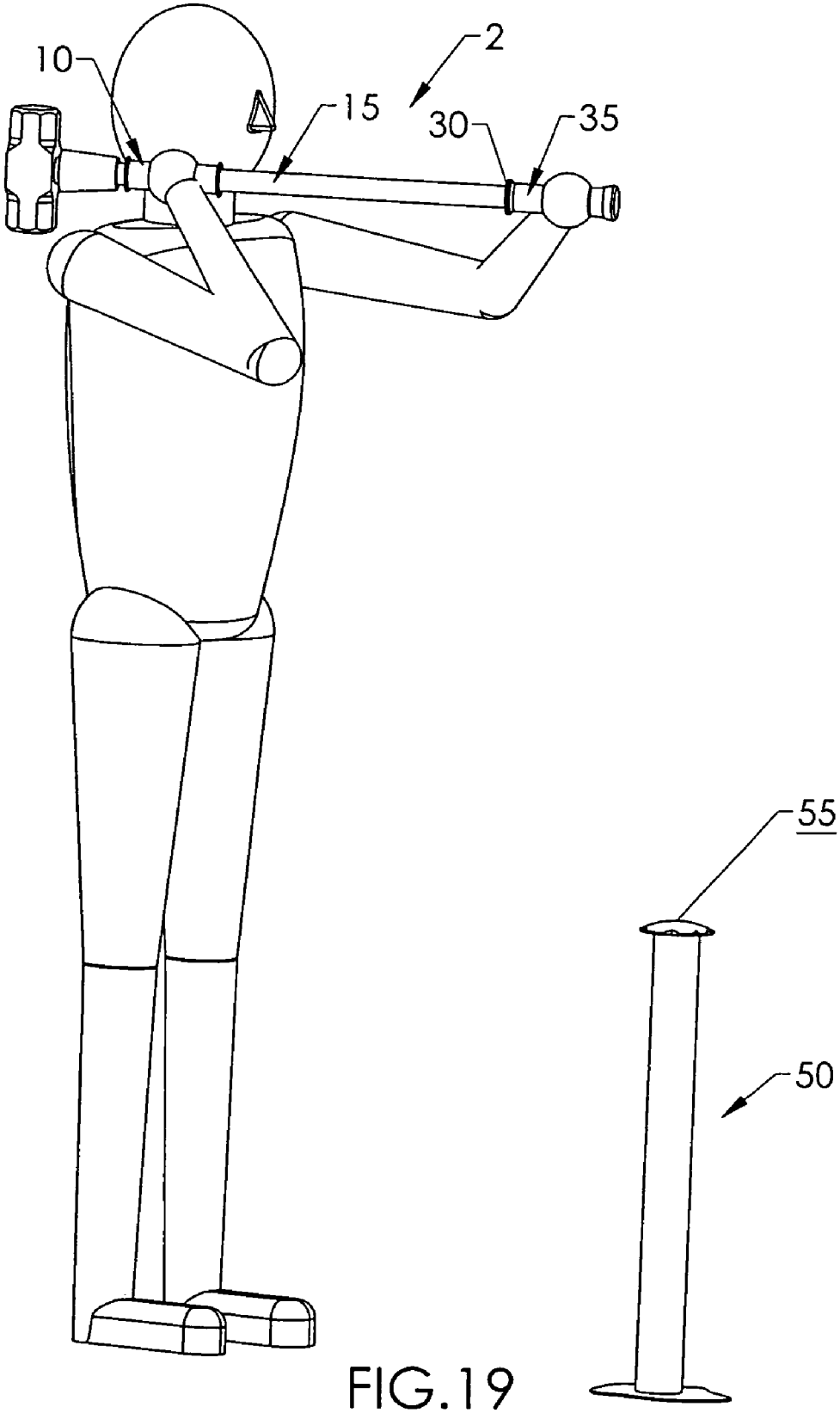
FIG. 19 is a schematic right side perspective view of a person that is using a sledge hammer according to an embodiment of the invention. The user has raised the sledge hammer generally above his shoulder, and his hands are separated on the tool; wherein his right hand is gripping the moveable hand grip and his left hand is gripping the proximal/rear end grip of the handle. Thus, his hands are nearly as far apart as they can be on the handle, and the right hand has conveniently and smoothly traveled on the moveable hand grip to its near-the-tool-head position. This position for the user's hands provides a large amount of stability and comfort to the user during this phase of the tool use.
Figure 20:
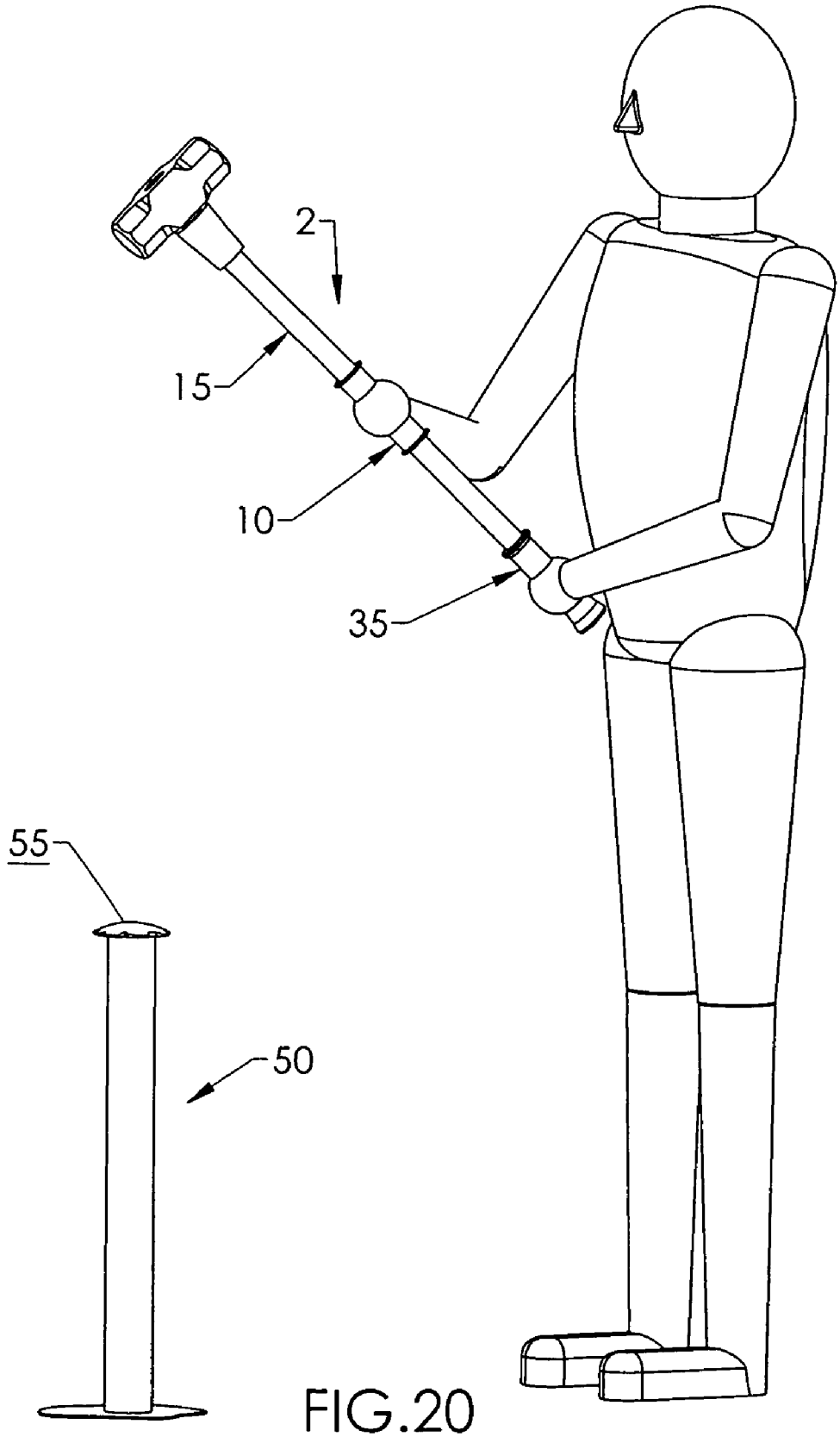
FIG. 20 portrays the user's continued use of the sledge hammer, viewed from the user's left side. The user has begun the downward-swing with the tool, toward the work piece that is an upright target post. One may see that, during this downward-swing of the tool, the left arm and hand pivot downward toward the user's waist, and the right arm and hand also pivot downward and forward toward the target post and, in doing so, the right hand is riding on the moveable hand grip rearward as said moveable grip slides toward the rear end of the handle. Thus, the user's right hand is coming closer to his left hand, still firmly gripping the moveable grip, and effectively aiming and swinging the tool toward the post work-piece. Note that the user does not have to loosen his front hand grip or move it relative to the moveable grip.
Figure 21:
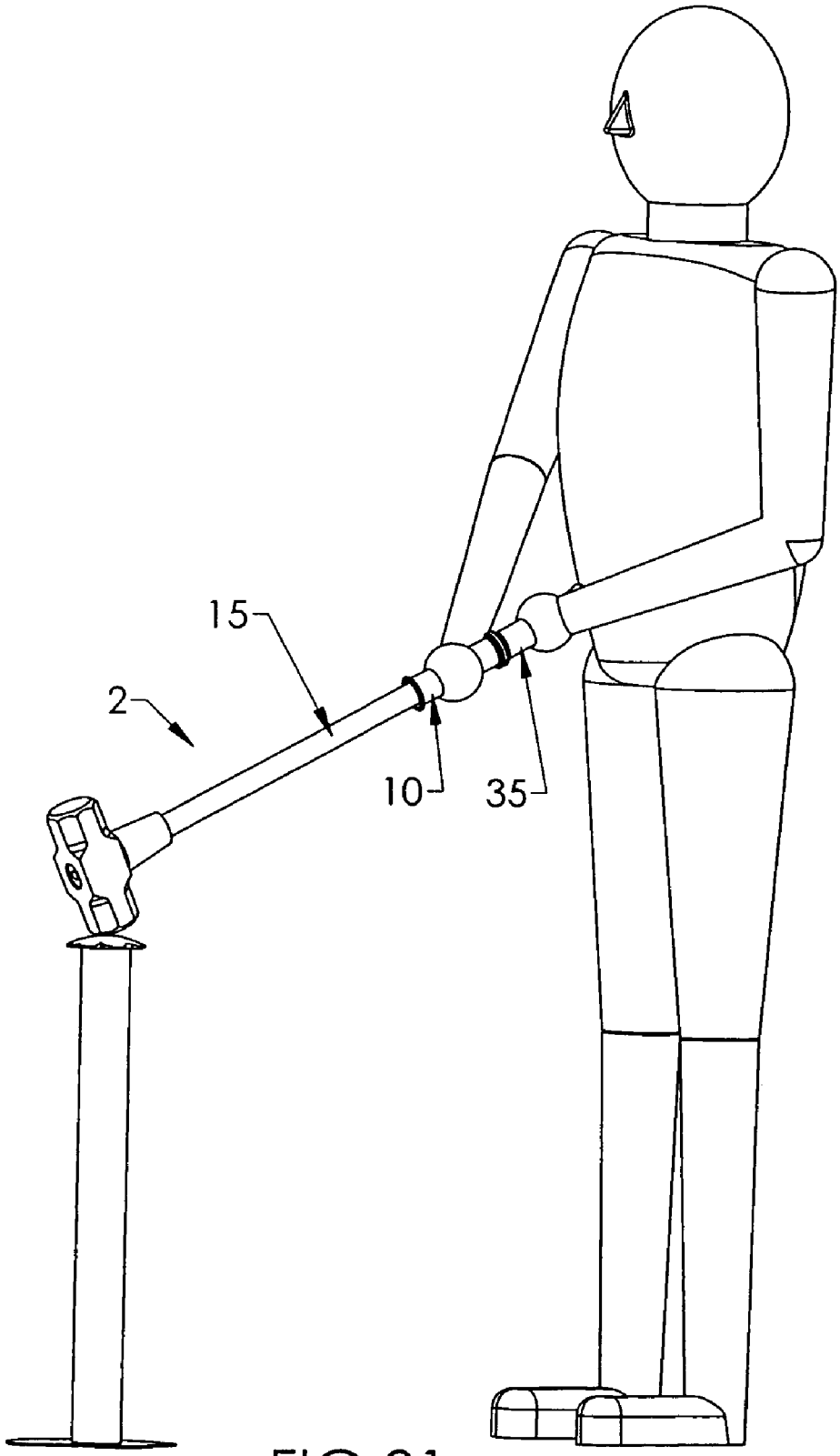
FIG. 21 illustrates the user having accomplished the swing of the hammer to impact the target post. Note that the right hand on the moveable grip has continued on its travel rearward toward the left hand grip. Now the two hands are very close together, preferably as close together as the moveable grip and the stationary rear grip will allow. Note that the proximal edge of the moveable grip has reached/abutted against the distal edge (flange or other stop) of the proximal grip.

Various embodiments of tools are shown in the Figures, including a sledge hammer 2, 2', 100 with hammer head 3, an axe-type tool 4, 4' with axe head 5, a pulaski-type tool 6, 6' with axe-adze head 7, and a pick 8 with pick head 9, wherein a moveable sleeve 10, 10' is provided that encircles the handle 15, 15', and is sized and shaped so that it slides smoothly from approximately the head to approximately the rear end. The invention may comprise the tools themselves, and/or the handle, moveable grip, and/or control member system that may be applied to various swung tools. The range of movement of the preferred sleeves is illustrated schematically in the figures, but is should be noted that preferably the range of movement is all the way (or nearly all the way except for the thickness of preferred control members) from a proximal stop to a distal stop, which may each be provided by various structures. The tool head stop preferably is the proximal end surface of the tool head assembly or a control member adjacent to the tool head assembly. The tool head stop may be provided by the attachment cylinder 31 of FIG. 1 or other attachment members 32, 33 of FIGS. 7 and 13, for example. The rear grip limit is preferably the distal end surface of the rear hand grip, provided by flange 30, or a control member adjacent to said read hand grip.

The flange 30 shown in the figures is one example of a stop, limit, flange, enlargement, gasket, ledge, or channel end for stopping movement of the moveable grip (or the adjacent control member) near the front of the rear hand grip area. Hand grip 35 and its flange 30 may be integrally molded into the handle or attached to the handle by adhesive, screw(s), or other fastener.

Other shapes and styles of rear hand grip and/or rear stop may be used. The stop may be a flange or ring that is unmoveably fixed to the handle at the appropriate position, without there being any extension from it in the rearward direction to act as a hand rip. In other words, the stop or may not be part of a hand grip, and the rear hand may optionally, but not preferably, grasp the bare end region of the handle that is not covered by any sleeve, tape, cover, or other extra layer.

The moveable grip is portrayed as a sleeve in the figures, but other shapes and configurations may be used. The sleeve 10, 10', however, is preferred because it is compact, receives the hand neatly and comfortably, does not interfere with other portions of the tool, and may be effectively adapted to provide the preferred non-rotation and non-shift function discussed elsewhere in this document.

The materials for the tool, including for the handle, the moveable hand grip, the distal and proximal stop means, and the rear hand grip (if any), may be various materials as desired, however, the preferred materials are weather-resistant and durable, and, most preferably, very hard and rigid. It is especially-preferred that the handle of the tools is fiberglass-filled but rigid and non-flexible and non-bendable. The handle could be wood, fiberglass-filled polymer, polymer/plastic, composite, metal, or other materials, but preferably comprises a hard polypropylene and/or polyethylene or other hard plastic/polymer outer layer. The moveable grip may also may be various materials as desired, however, the preferred materials are weather-resistant and durable, and, most preferably, very hard and rigid. It is especially-preferred that the moveable grip be rigid and non-flexible and non-bendable. The moveable grip could be wood, polymer/plastic, composite, metal, or other materials, but is preferably is hard polypropylene and/or polyethylene or other hard plastic/polymer.

In preferred embodiments, one or more control members are added to the device, for use at times that sliding of the moveable grip is not desired. Said times may be when the user is carrying the tool, transporting the tool, or otherwise handling or storing the tool when the functionality of the moveable grip is not needed. For some people, having the moveable grip slide at times other than when it is needed may be slightly irritating or possible noisy. It should be noted that the control members are preferably separate from, and provided in addition to, a non-moveable distal stop member (examples being cylinder and members 31, 32 and 33) and a non-moveable proximal stop member (examples being flange 30 of grip 35).

Figure 22:
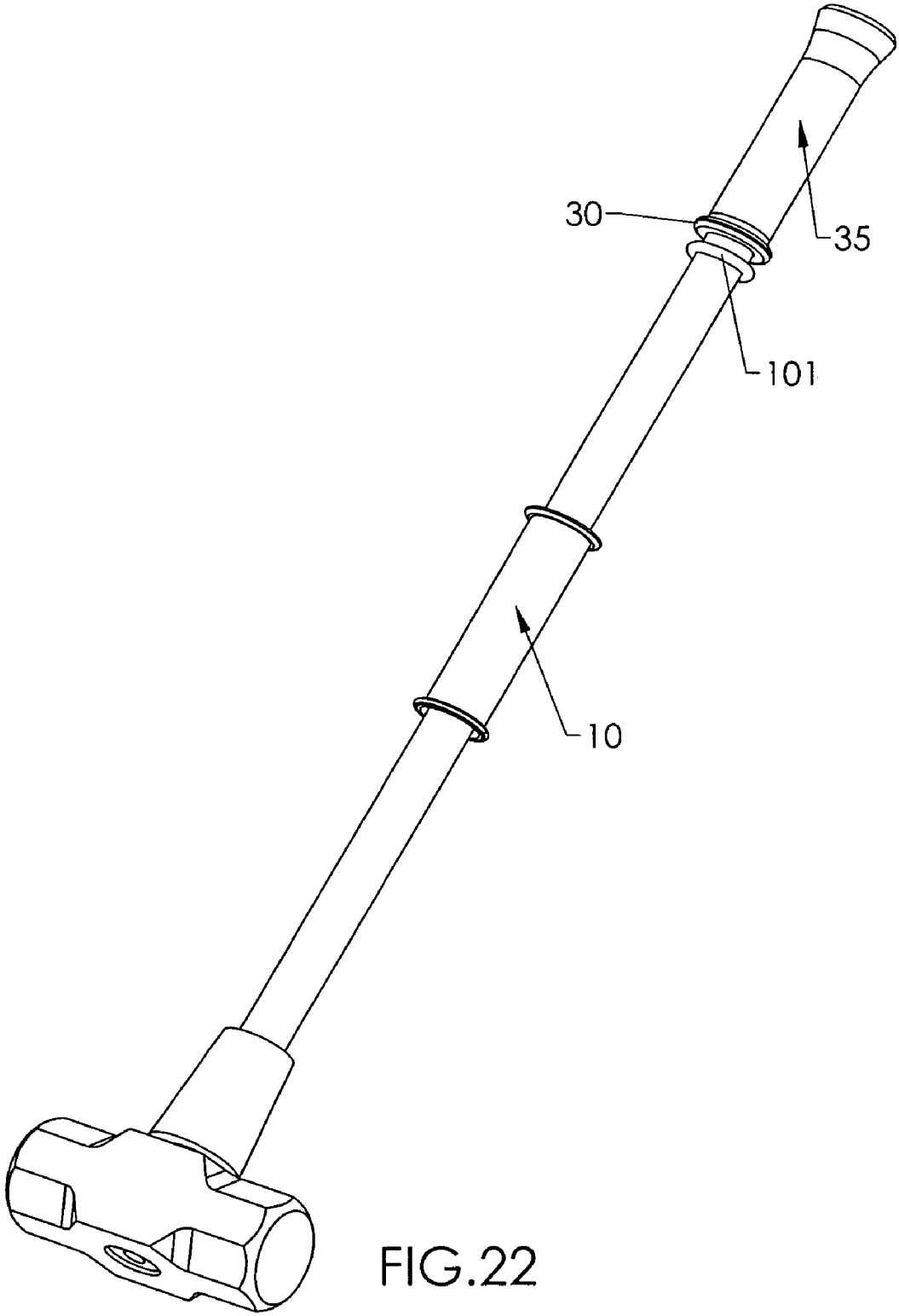
FIGS. 22 and 23 illustrate an alternative embodiment of the invention comprising one embodiment of a control member, in the form of an O-ring shaped member positioned around the handle. The control member is adapted to be placed against the movable grip when it is desired to stop sliding of the moveable grip, for example, for carrying and other handling wherein the moveable grip does not need to slide and/or wherein the user does not want to the sleeve to slide.
Figure 23:
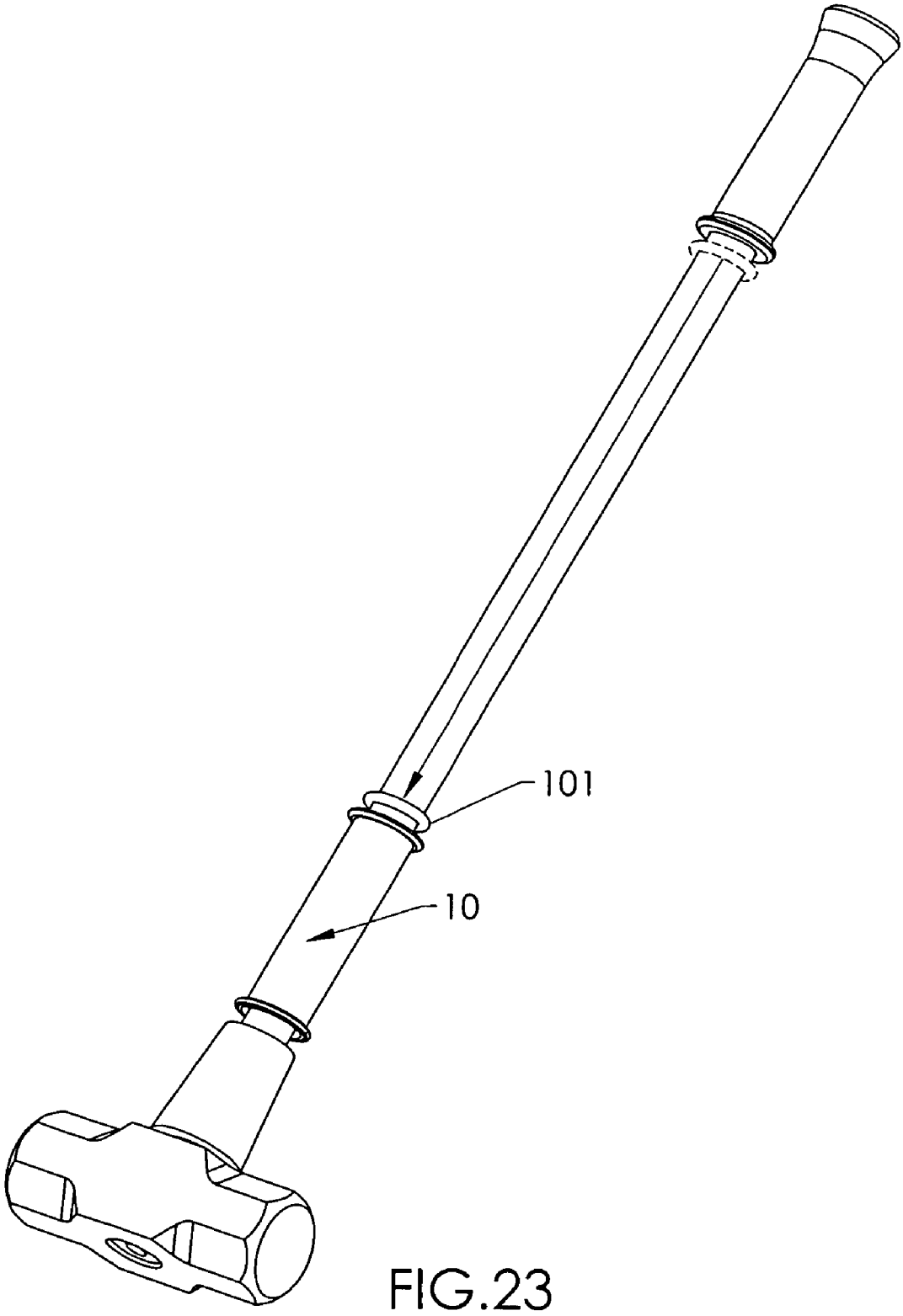

FIG. 22 portrays an embodiment wherein a single control member is provided between the sleeve 10 and the front flange 30 of the rear hand grip 35. The control member 101 in FIG. 22 takes the form of an O-ring, that extends snugly around the handle and, due to its resiliency and/or tackiness, stays in place on the handle until the user purposely slides or rolls it along the length of the handle. Preferably, the O-ring is circular in overall shape and also circular in cross-section. In FIG. 22, because of the position of the control member 101, the sleeve 10 is free to slide longitudinally on the handle. In FIG. 23, the sleeve 10 has slid nearly all the way toward the head of the sledge hammer, and the control member 101 has also been slid (or rolled, as those familiar with an O-ring will understand) nearer to the head end of the hammer, so that the sleeve is trapped near the head and will not slide any significant amount.

Figure 24:
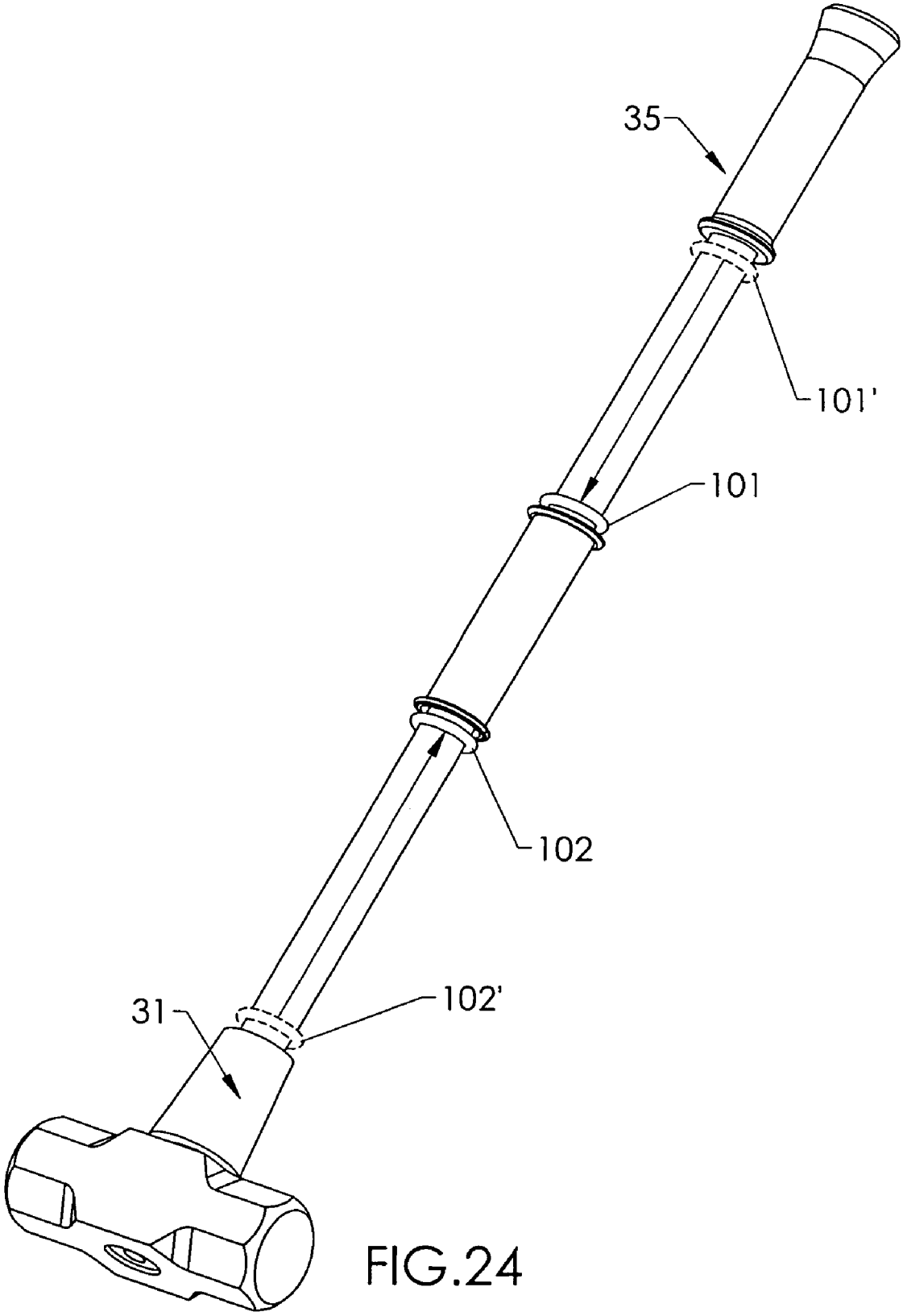
FIG. 24 illustrates an alternative embodiment having two grip control members of the type illustrated in FIG. 23. The two O-ring-type control members are located on the tool handle at each end of the moveable grip.
Figure 25:
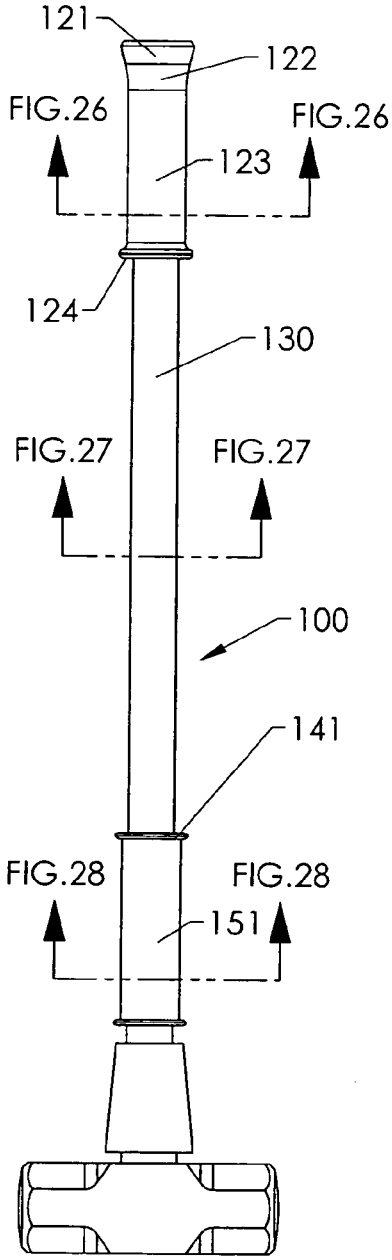
FIGS. 25-28 illustrate a side view of a sledge hammer (FIG. 25) that is similar to the sledge hammer of FIGS. 1-4, and illustrate various cross-sections (FIGS. 26-28) along the length of the sledge hammer of FIG. 25.

FIG. 24 illustrates two control members, 101 and 102, one of which is positioned on each end of the moveable sleeve 10, and which are continuously moveable and fixable in positions between the rear grip 35 and the sleeve 10, and between the sleeve 10 and tool head attachment member 31, respectively. In FIG. 24, control member 101 is portrayed in solid lines in its position near the center of the handle and in dashed lines (as 101') in its position near the rear grip 35. In FIG. 24, control member 102 is portrayed in solid lines in its position near the center of the handle and in dashed lines (as 102') in its position near attachment member 31. By using two control members, one may retain sleeve 10 between the two control members substantially any place along the length of the handle.

The control member may be of various designs, such as the illustrated O-ring(s), or another moveable and lockable loop or strap. The control member preferably is resilient and firm, but does not need to be capable of stopping the sleeve from sliding under great force. A portion of the rear hand grip and a portion of the tool head assembly preferably stop the sleeve near the rear end and the head end of the tool, respectively, and therefore said portions of the rear grip and head assembly need to be strong and fixed firmly enough to stop the sleeve from sliding during a swing caused by the user's force and by gravity. Said portions may be slightly resilient or cushioning, if desired, but are preferably not moveable or adjustable along the handle. On the other hand, the control member(s) is meant to abut against, limit, or otherwise interfere with the sleeve sliding a significant distance preferably only under the force of gravity, and is not necessarily required to limit sleeve movement if the user grasps the sleeve to force it to move. The control member(s) are therefore moveable and "fixable," wherein "fixable" in this context refers to temporarily remaining in place until the user moves the control members, instead of freely sliding. The O-ring-style control members frictionally or elastically grip the handle, so that they preferably do not slide or move unless a user purposely slides or rolls it, and, hence, may be called "fixable."

When a single control member is provided, there are two slidable members provided on the handle, one being the moveable hand grip (for example, sleeve 10, which is freely slidable) and the other being the moveable control member positionable by the user for retaining the otherwise-freely-slidable sleeve in any desired location along the range of sleeve motion. When two control members are provided on the handle, there are three slidable members; the moveable hand grip, which again is preferably freely slidable, and two moveable control members independently and selectively positionable by the user for retaining the otherwise-freely-slidable sleeve in any desired location along the range of the sleeve motion.

When multiple control members are provided, the user may chose to use one or both of the control members to retain the sleeve in the desired location. For example, when it is desirable to retain the sleeve midway along the handle, preferably two control members may be moved to each end of the sleeve, to retain the sleeve on both ends so that the sleeve does not slide in either direction along the handle. If it is desirable to retain the sleeve near one end or the other end of the handle, then the sleeve and both control members will be moved to said one end or the other of the tool handle.

Figure 29:
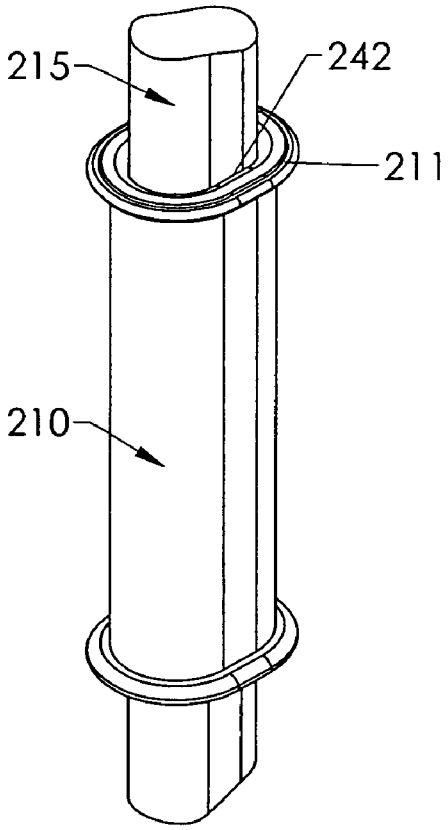
FIGS. 29-31 illustrate views of a handle and cooperating sleeve that have flattened axial portions, which, in addition, to their generally-oval shape, serve to mate the sleeve to the handle and prevent rotation of the sleeve relative to the handle.
Figure 30:
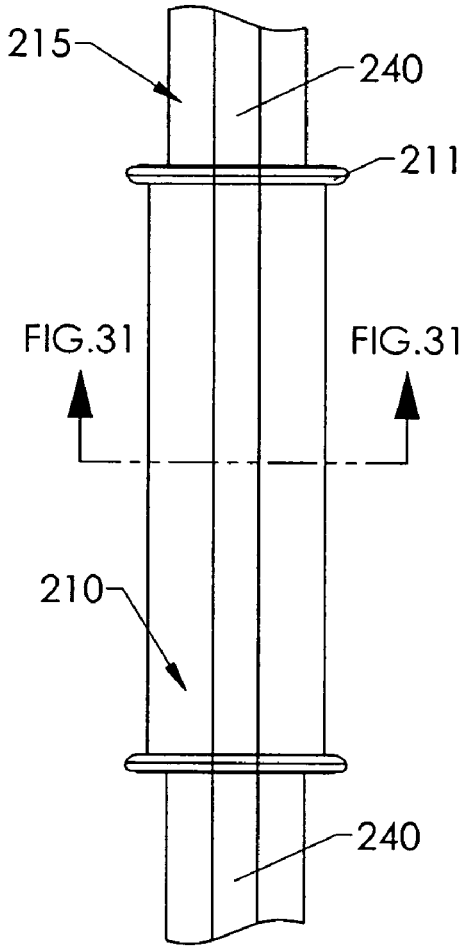
Figure 31:
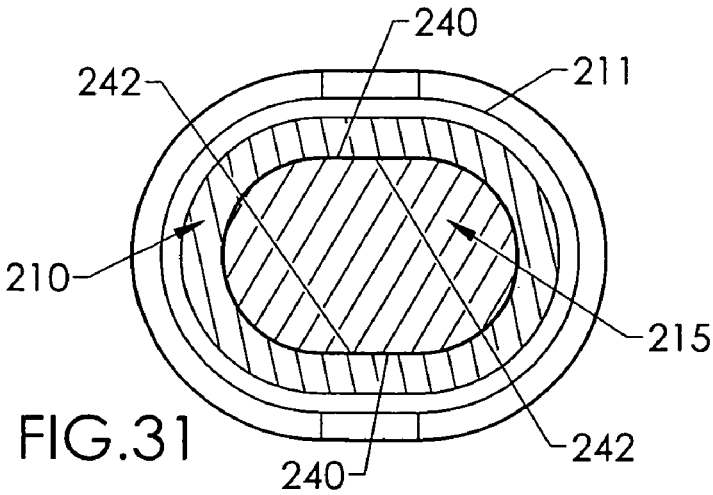

Several of the embodiments in the figures comprise oval handles and sleeves (in cross-section, see FIGS. 1-4, 19-28), or handles and sleeves with flattened surface portions (see FIGS. 5-18, and 29-31), or handles and sleeves with cooperating axial grooves and ridges (see FIGS. 32-37) or other cooperating keyways, channels, axial indents, or other mating structures. These are examples of some, but not the only, methods of creating a substantially non-rotational operative connection between the moveable grip and the handle for limiting or preferably preventing rotation of the moveable grip relative to the handle of the tool. As shown in FIGS. 29-31, flattened surface portions 240 of the handles run axially along the exterior surface of the handle 215, and the corresponding flattened surface portions 242 of the sleeves run axially along the interior surface of the sleeve 210. See also, for example, the exterior-surface grooves 340 of handle 315 and the cooperating interior-surface ridges 342 of sleeve 310 in FIGS. 32-34, and the exterior-surface edge grooves 440 and cooperating interior-surface edge ridges 442 of sleeve 410 in FIGS. 35-37.

Figure 5:
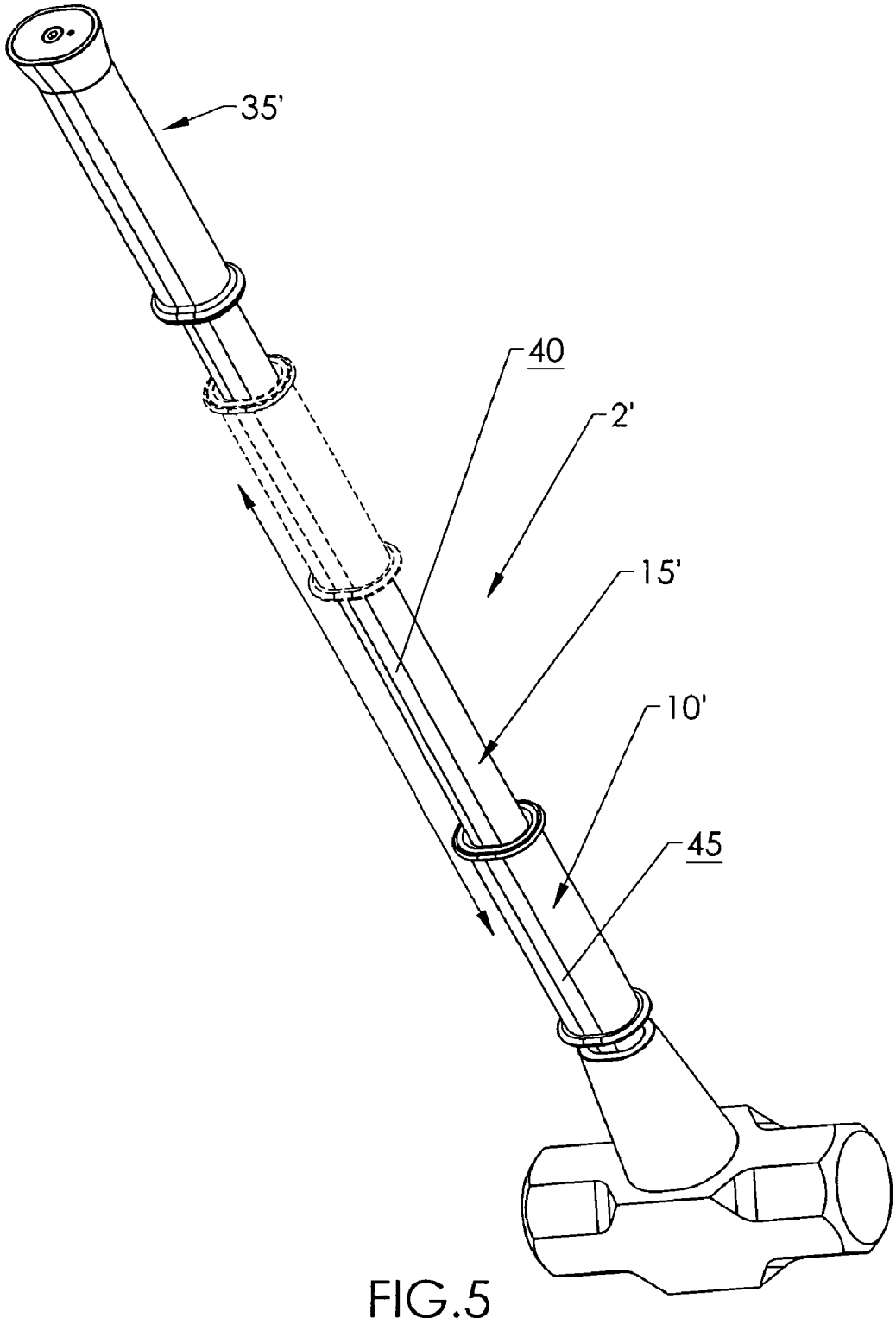
FIG. 5 is a perspective view of an alternative embodiment of the invention, which is a sledge hammer comprising a generally oval tool handle and a moveable hand grip that each have flat surfaces for slidable, but non-rotatable cooperation.
Figure 6:
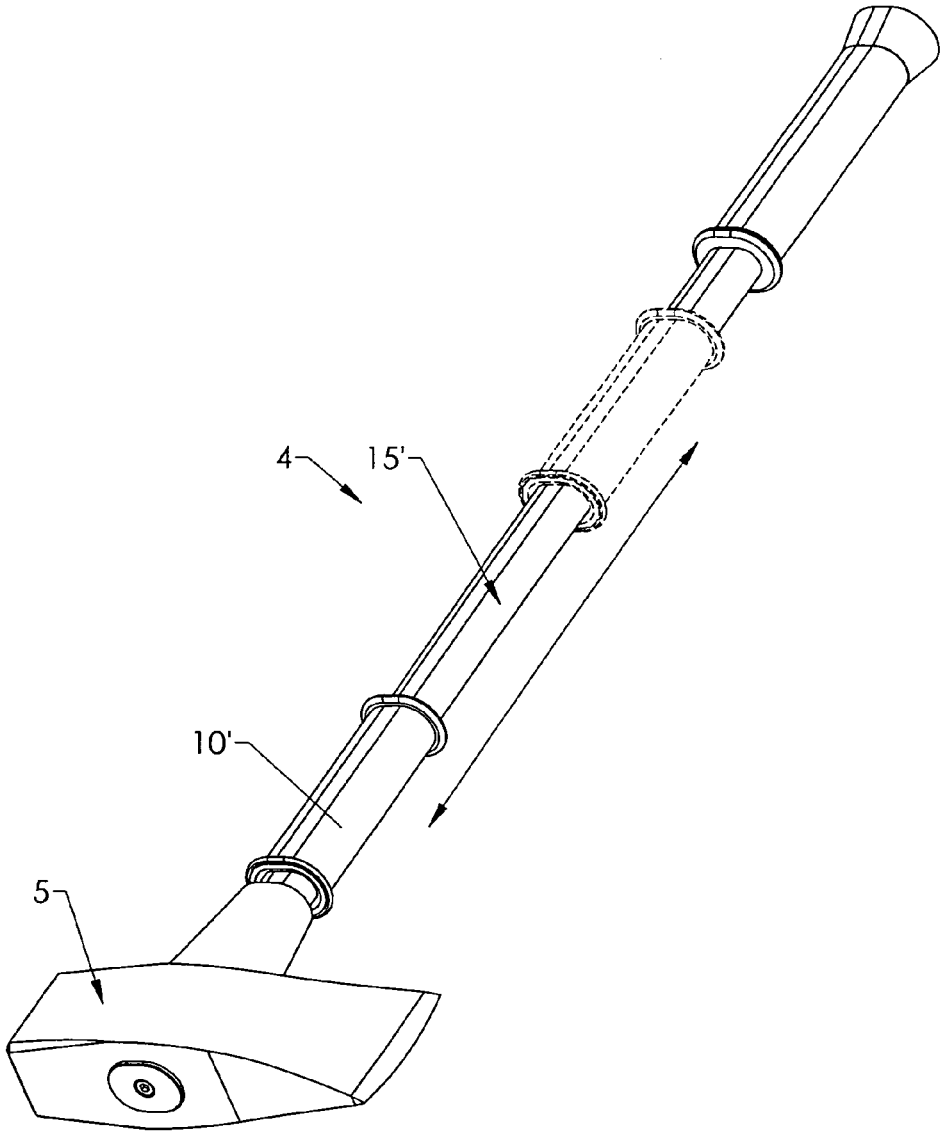
FIG. 6 is a perspective view of another embodiment of the invention, wherein the tool handle, moveable hand grip, and rear hand grip of the embodiment of FIG. 5 is provided for an axe tool head.

Note that, in FIG. 5, flattened surface 45 is an exterior surface of the sleeve 10'. In this sleeve 10', the exterior surface and the interior surface of the sleeve 10' have similar, axial flattened surfaces. While it is preferred that the sleeve has an oval, flattened, or otherwise non-circular exterior surface to enhance the user's grip and non-rotation of the sleeve in the user's hand, the sleeve exterior surface is not required to be an identical shape as the sleeve interior surface.

These adaptations produce handles and sleeves that are non-circular and mating in ways that allow longitudinal sliding of the sleeve along the handle but not significant rotating or twisting movement of the sleeve relative to the handle. By "significant" rotation, it is meant that the sleeve may rotate on its axis 10 degrees or less relative to the handle, and preferably rotates on its axis in a range of only 0-8 degrees.

As discussed above, this low- or no-rotation feature is made possible by non-rotation systems such as mating, non-circular shapes or other keying, but also requires a fairly tight fit between the sleeve and the handle. The preferred sleeve fits snugly to its respective handle, preferably with about 1.5-5 mm of gap between the sleeve interior surface and the handle exterior surface all the way around the sleeve. This range of gap size, and more preferably 1.5-3 mm, is believed to be effective for the non-rotational adaptation (and for the non-shifting adaptation, discussed below), while allowing enough space between the sleeve and the handle to allow the sleeve to work well in spite of dirt, sand, or other grime or grit that might become lodges inside the gap. If grime or grip becomes lodged in the gap, a user may easily clear out the grim or grit with a thin tool or by "pumping" the sleeve back and forth. The preferred gap size also will allow sliding of the sleeve but will prevent "wobbling" of the preferably 5-6 inch-long sleeve on the handle that might result in the sleeve catching on the handle.

The preferred gap size of 1.5-5 mm, and more preferably of 1.5-3 mm, also ensures a substantially non-transverse-shifting operative connection between the moveable grip and the handle, for limiting or preferably the handle can shift transversely (perpendicular to the longitudinal axis L of the tool) only up to a maximum of 10 mm relative to the sleeve, and more preferably only up to a maximum of 6 mm relative to the sleeve. To arrive at this maximum shift, the gaps on two sides of the handle are summed, because, in theory, the handle could shift all the way from contact with one side of the sleeve to contact with the other side of the sleeve. This gap size, combined with the handle and sleeve being very rigid and hard, prevents more transverse shifting and, therefore, prevents the longitudinal axis of the tool becoming significantly offset from the longitudinal axis of the sleeve during the swing and impact. This helps prevent significant shifting of the tool significantly off of the intended swing plane and the intended impact point on the target. Therefore, the term "significant transverse shifting" in this context and the claims means shifting transversely inside the sleeve more than 10 mm.

Figure 26:
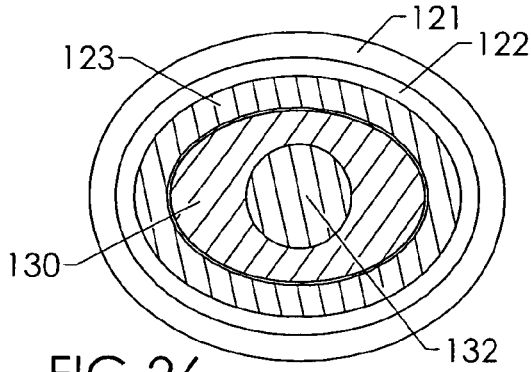
Figure 27:
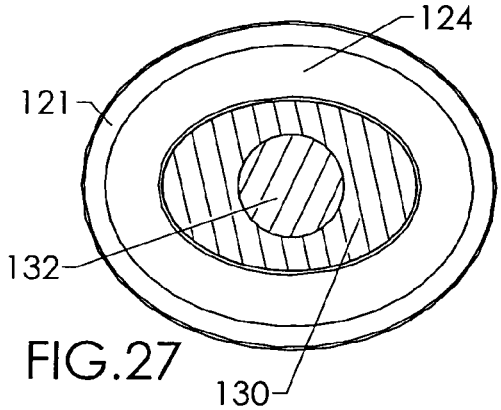
Figure 28:
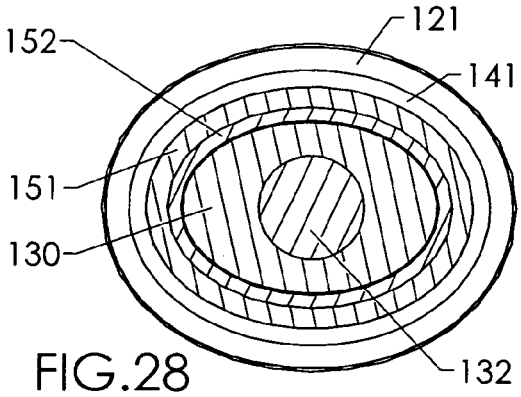

Specifically referring to FIGS. 25-28, an oval adaptation for a cooperating handle and sleeve allows longitudinal relative movement but not rotational relative movement. The cross-sectional views may be described as follows. In FIG. 26, one may see the portion 121 and portion 122 of the rear hand grip, the main body 123 of the rear hand grip, the main body of the handle 130 and the fiberglass or other core 132 of the handle. In FIG. 27, one may see the rear grip portion 121, the front flange 124 of the rear hand grip, and the main body 130 and the core 132 of the handle. In FIG. 28, one may see portion 121 of the rear hand grip (relatively far in the distance), a flange 141 of the sleeve, two layers 151, 152 of the sleeve, and the main body 130 and core 132 of the handle. Note that the handle main body 130 has an outer surface that is oval in cross-section, and the sleeve has an inner surface that is also oval and that fits snugly against the main body 130. This way, the sleeve cannot rotate on the handle. Also, because the sleeve is preferably rigid and will not collapse or significantly change its shape, it is not capable of bending or flexing to allow rotation relative to the handle. Also, because the sleeve is rigid and non-collapsible, the user will not be able to grasp the sleeve so firmly that it will collapse on the handle to become immovable. Further, it may be noticed that the preferred sleeves are continuous around the handle and do not have slits or openings that might allow flexing, collapse, snapping off or other easy removal of the sleeve from the handle.

Referring to FIGS. 29-31, handle 215 and sleeve 210 are illustrated, which are the same or similar to the handle and sleeve components of the embodiments of FIGS. 5-18. In the cross-sectional view of FIG. 31, one may see to best advantage the flattened surfaces 240 of the handle and the cooperating, mating flattened interior surfaces of the sleeve 210.

Figure 32:
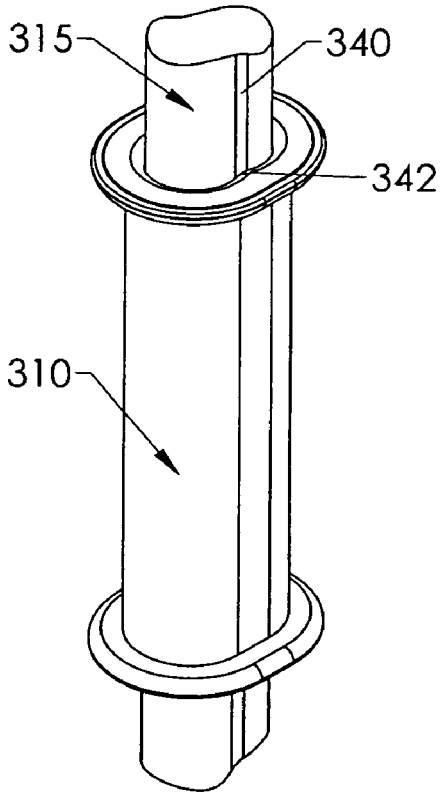
FIGS. 32-34 illustrate views of a handle and cooperating sleeve that have sides (the relatively broad sides of the handle and sleeve) with cooperating grooves and ridges, which, in addition to their generally-oval shape, serve to mate the sleeve to the handle and prevent rotation of the sleeve relative to the handle.
Figure 33:
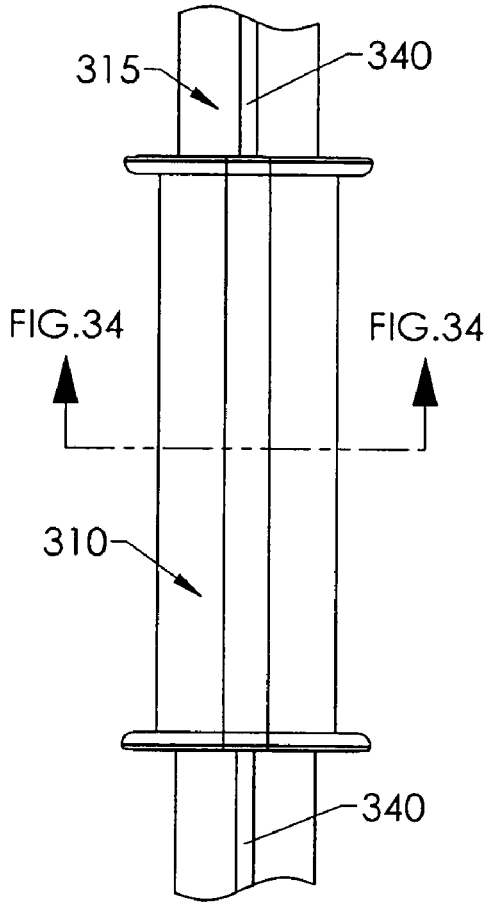
Figure 34:
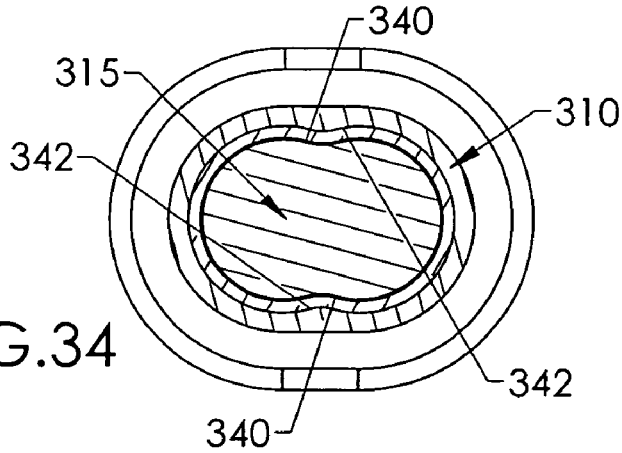

Referring to FIGS. 32-34, handle 315 and sleeve 310 are illustrated. In the cross-sectional view of FIG. 34, one may see to best advantage the grooves 340 of handle 315 and the cooperating ridges 342 of sleeve 310.

Figure 35:
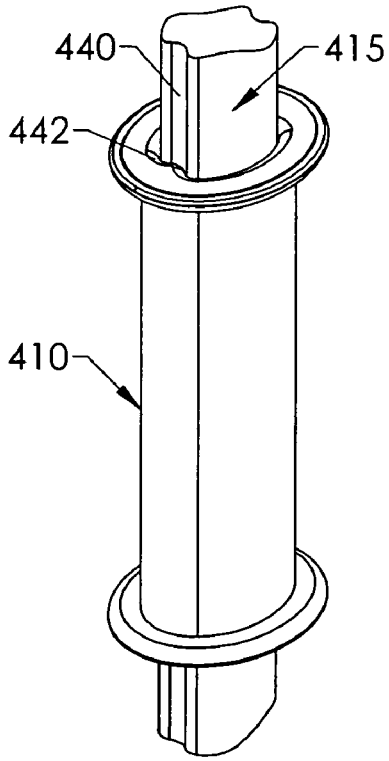
FIGS. 35-37 illustrate views of a handle and cooperating sleeve that have edges (the relatively narrow sides of the handle and sleeve) with cooperating grooves and ridges, which, in addition to their generally-oval shape, serve to mate the sleeve to the handle and prevent rotation of the sleeve relative to the handle.
Figure 36:
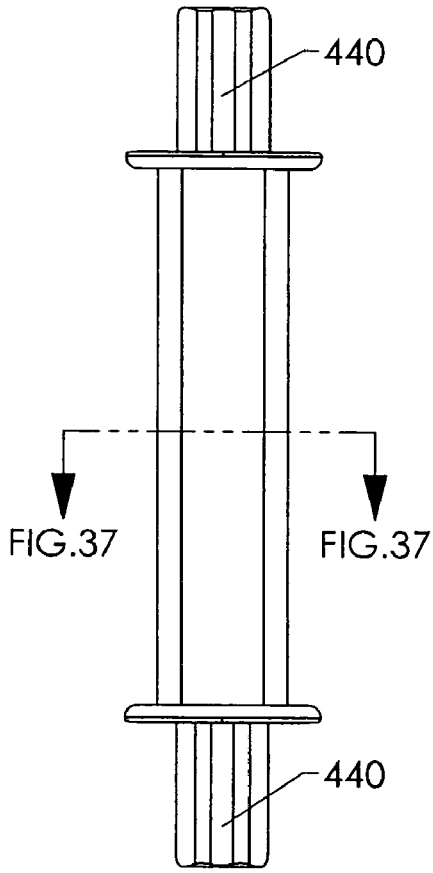
Figure 37:
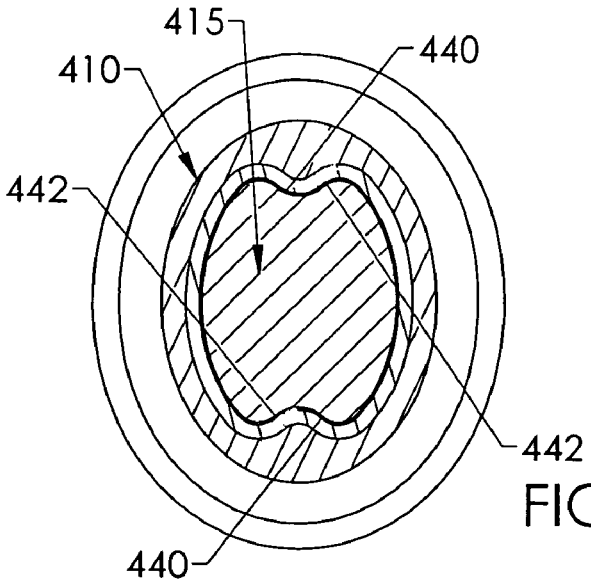

Referring to FIGS. 35-37, handle 415 and sleeve 410 are illustrated. Edge grooves 440 and cooperating edge ridges 442 of sleeve 410 are provided at positions generally 90 degrees from the grooves and ridges of the embodiment of FIGS. 32-34.

In summary, the preferred embodiment may comprise apparatus and methods for making tools that are swung toward a work-piece more accurate, comfortable, easy, and/or safer to use. The present invention comprises a movable grip on the handle of swung tools, which may be grasped by a hand of the user during use of the tool at any time that movement of the user's two hands relative to each other on the handle is needed or convenient, and/or at any time movement of one hand relative to the handle is needed or convenient. The movable grip preferably slides along the handle only in axial directions (forward and rearward) parallel to the longitudinal axis of the handle, providing the user a firm, reliable, predictable, smooth-moving grasp-point that does not rotate, twist, or transversely shift a significant amount relative to the handle. The size, shape, and rigidity adaptations that result in said reduced or eliminated rotation and/or transverse shifting may also be described as examples of an operative connection that reduced or eliminates rotation and/or transverse shifting. While there is preferably a gap of space between the moveable grip, so that it slides, still this cooperation between the grip and the handle may be called an operative connection. By using this movable hand grip, the user may move his hand relative to the handle, relative to the tool head, and relative to his/her other hand, in a direction and manner much like the user's natural hand movement would be during normal use of the tool, but with the added, important benefit that the moveable grip/sleeve does not rotate/twist a significant amount during the swing. The movable grip eliminates the need for the forward hand of the user to loosen its grip during portions or all of the swing, eliminates the need for the hand itself to slide along the surface of the handle, and, importantly, greatly reduces or eliminates the chance that the tool will rotate or shift relative to the grip and the hand and cause an inaccurate or unsafe impact. These results eliminate possible problems in operation of the tool that may increase mistakes, accidents, inaccurate impacts, fatigue, and other unsafe conditions. In addition, the preferred embodiment includes one or more members or systems for retaining or latching the moveable grip in one or more desired locations along the handle (either increment adjustment or continuous adjustment of retained/latched location) so that the moveable grip may be prevented from sliding until the user desires it to slide. Preferably, the moveable grip is rigid and not compressible or flexible, and preferably at least the exterior surface of the handle is rigid and not compressible or flexible; this way, normal use of the tool will not allow the sleeve to change shape or the handle exterior surface to change shape to permit rotation or shifting of the sleeve relative to the handle. Preferably, both the sleeve and the handle exterior surface are hard, rigid polymeric material (commonly called "hard, rigid plastic").

Therefore, apparatus and methods are disclosed for making tools that are swung toward a work-piece more accurate, comfortable, easy, and/or safer to use. The preferred embodiments comprise a movable grip on the handle of such tools, which may be grasped by a hand of the user during use of the tool at any time that movement of the user's two hands relative to each other on the handle is needed or convenient, and/or at any time movement of one hand relative to the handle is needed or convenient. The movable grip preferably slides along the handle in a direction only parallel to the longitudinal axis of the handle, providing the user a firm, reliable, predictable, smooth-moving grasp-point that does not rotate or twist relative to the handle, and especially does not rotate or twist relative to the handle around the handle axis during use of the tool. By using this movable grip, the user may move his hand relative to the handle, relative to the tool head, and relative to his/her other hand, in a direction and manner much like the user's natural hand movement would be during normal use of the tool, but with the added, important benefit that the moveable grip does not rotate/twist. The movable grip eliminates the need for the forward hand of the user to loosen its grip during portions or all of the swing, eliminates the need for the hand itself to slide along the surface of the handle, and, importantly, greatly reduces or eliminates the chance that the hand or forward grip will rotate or twist relative to the handle and the impact head of the tool. These results eliminate possible problems in operation of the tool that may increase mistakes, accidents, inaccurate impacts, fatigue, and other unsafe conditions. In addition, the preferred embodiment includes one or more control members for retaining or latching the moveable grip in one or more desired locations on the handle, so that the moveable grip may be prevented from sliding along the handle until the user desires it to slide. The control members may be moveable O-rings that are fixable in that they elastically grip the handle. The control members are preferably not large enough and not adapted for being a grip for the user's hand during swinging of the tool, and, therefore, are supplied in addition to a distal stop and a proximal stop on the handle and/or head assembly.

Although this invention has been described above with reference to particular means, materials and embodiments, it is to be understood that the invention is not limited to these disclosed particulars, but extends instead to all equivalents within the broad scope of the following claims.

The invention claimed is:

1. An impact tool having an impact head and an elongated handle perpendicular to the longitudinal axis of the head and having a distal end and a proximal end;

a moveable grip provided on the handle and slidable in a direction parallel to the longitudinal axis of the handle;

a stationary rear grip connected to the proximal end of the handle, the stationary rear grip comprising a proximal stop at or near a distal end surface of the stationary rear grip, wherein said proximal stop is not adjustable along the length of the handle;

a distal stop on the handle adjacent to the head and not adjustable along the length of the handle;

a first control member encircling the handle between said distal stop and said moveable grip, said first control member being adjustable along the length of the handle from a position against said distal stop to a position against a distal edge of the moveable grip; and a second control member encircling the handle between said moveable grip and said proximal stop of the rear grip, said second control member being adjustable along the length of the handle from a position against said proximal stop of the rear grip to a position against a proximal edge of the moveable grip;

wherein said moveable grip has an interior surface, said handle has a handle exterior surface, and said moveable grip and said handle are rigid and non-compressible;

wherein said moveable grip interior surface and said handle exterior surface are each generally oval in cross-section and have flattened axial surfaces extending along lengths of said moveable grip and said handle, and a gap of 1.5-3 mm exists between said moveable grip interior surface and said handle exterior surface all the way around said handle, so that the moveable grip slides along the handle and does not rotate relative to the handle around the axis of the handle more than 10 degrees;

wherein said first control member and said second control member are each sized to prevent the moveable grip from sliding over said first control and said second control member to prevent said moveable grip from sliding along the handle beyond the first and second control members; and wherein, in an in-use configuration, said first control member is positioned against said distal stop, the second control member is positioned against said proximal stop, and the moveable grip is slidable from near the head to near the stationary rear grip during a swing of the impact tool toward a target; and wherein, in a storage configuration, the first control member is positioned against said distal edge of the moveable grip, and the second control member is positioned against said proximal edge of the moveable grip, so that said first and second control members retain said moveable grip in a selected position along the length of the handle for carrying, transport, or storage of the tool.

2. A tool as in claim 1, wherein said head is selected from a group consisting of: an axe head, a hammer head, a pick head, an adze head, and a pulaski head.

3. A tool as in claim 1, wherein said first control member and said second control member are both o-rings.

4. A tool as in claim 1, wherein said moveable grip is adapted to rotate 0-8 degrees relative to the handle.

5. A tool as in claim 2, wherein said moveable grip is adapted to rotate 0-8 degrees relative to the handle.

6. A tool as in claim 3, wherein said O-rings are each elastic and resilient.

* * * * *